US010854130B2

(12) United States Patent
Wang et al.

(10) Patent No.: US 10,854,130 B2
(45) Date of Patent: Dec. 1, 2020

(54) GATE DRIVING UNIT, GATE DRIVING METHOD, GATE DRIVING CIRCUIT AND DISPLAY DEVICE

(71) Applicants: HEFEI XINSHENG OPTOELECTRONICS TECHNOLOGY CO., LTD., Hefei (CN); BOE TECHNOLOGY GROUP CO., LTD., Beijing (CN)

(72) Inventors: Zheng Wang, Beijing (CN); Jinliang Liu, Beijing (CN); Songmei Sun, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/583,089

(22) Filed: Sep. 25, 2019

(65) Prior Publication Data

US 2020/0294441 A1 Sep. 17, 2020

(30) Foreign Application Priority Data

Mar. 11, 2019 (CN) ..... 2019 1 0179651

(51) Int. Cl.
*G09G 3/3266* (2016.01)
*G09G 3/20* (2006.01)

(52) U.S. Cl.
CPC ... *G09G 3/2092* (2013.01); *G09G 2310/0267* (2013.01); *G09G 2310/08* (2013.01)

(58) Field of Classification Search
CPC ..... G09G 3/2092; G09G 2310/0267; G09G 2310/08; G09G 3/3266
See application file for complete search history.

(56) References Cited

U.S. PATENT DOCUMENTS

2017/0039971 A1* 2/2017 Huang ..... G11C 19/184

OTHER PUBLICATIONS

Yuying Cai, Study on Bias-stress-induced Threshold Voltage Shift of TFT, China,87 pages.

* cited by examiner

*Primary Examiner* — Dennis P Joseph
(74) *Attorney, Agent, or Firm* — Kinney & Lange, P.A.

(57) ABSTRACT

A gate driving unit includes a first pull-down node control circuit, a second pull-down node control circuit and a pull-up node resetting circuit. The first/second pull-down node control circuit is configured to control a first/second pull-down node to be electrically connected to, or electrically disconnected from, a second/first control voltage end under the control of a potential at a pull-up node. The pull-up node resetting circuit is configured to control the pull-up node to be electrically connected to the second control voltage end under the control of a potential at the first pull-down node, and control the pull-up node to be electrically connected to the first control voltage end under the control of a potential at the second pull-down node.

18 Claims, 9 Drawing Sheets

GATE DRIVING UNIT, GATE DRIVING METHOD, GATE DRIVING CIRCUIT AND DISPLAY DEVICE

CROSS-REFERENCE TO RELATED APPLICATION

The present application claims a priority of the Chinese patent application No. 201910179651.4 filed on Mar. 11, 2019, which is incorporated herein by reference in its entirety.

TECHNICAL FIELD

The present disclosure relates to the field of display driving technology, in particular to a gate driving unit, a gate driving method, a gate driving circuit and a display device.

BACKGROUND

Gate On Array (GOA) products have been widely used due to such advantages as low manufacture cost and narrow bezel. However, in some occasions where a display panel is required to be in a continuous on state, a characteristic of each transistor of a GOA circuit may be deteriorated under the effect of a driving stress applied continuously in a same direction. When a serious drift occurs for a threshold voltage of the transistor, a charging/discharging capability of a pull-up node may be adversely affected, resulting in an output abnormality for the GOA circuit.

SUMMARY

In one aspect, the present disclosure provides in some embodiments a gate driving unit, including a first pull-down node control circuit, a second pull-down node control circuit and a pull-up node resetting circuit. The first pull-down node control circuit is connected to a pull-up node, a first pull-down node and a second control voltage end, and configured to control the first pull-down node to be electrically connected to, or electrically disconnected from, the second control voltage end under the control of a potential at the pull-up node. The second pull-down node control circuit is connected to the pull-up node, a second pull-down node and a first control voltage end, and configured to control the second pull-down node to be electrically connected to, or electrically disconnected from, the first control voltage end under the control of the potential at the pull-up node. The pull-up node resetting circuit is connected to the first pull-down node, the second pull-down node, the pull-up node, the first control voltage end and the second control voltage end, and configured to control the pull-up node to be electrically connected to the second control voltage end under the control of a potential at the first pull-down node, and control the pull-up node to be electrically connected to the first control voltage end under the control of a potential at the second pull-down node.

In a possible embodiment of the present disclosure, the gate driving unit further includes a pull-down node resetting circuit connected to a resetting end, the first pull-down node, the second pull-down node and a first level end, and configured to, under the control of a resetting signal from the resetting end, control the first pull-down node to be electrically connected to the first level end, and control the second pull-down node to be electrically connected to the first level end.

In a possible embodiment of the present disclosure, the first pull-down node control circuit includes a first pull-down node control transistor, a control electrode of which is connected to the pull-up node, a first electrode of which is connected to the first pull-down node, and a second electrode of which is connected to the second control voltage end. The second pull-down node control circuit includes a second pull-down node control transistor, a control electrode of which is connected to the pull-up node, a first electrode of which is connected to the second pull-down node, and a second electrode of which is connected to the first control voltage end.

In a possible embodiment of the present disclosure, the pull-up node resetting circuit includes a first pull-up node resetting transistor and a second pull-up node resetting transistor. A control electrode of the first pull-up node resetting transistor is connected to the first pull-down node, a first electrode of the first pull-up node resetting transistor is connected to the pull-up node, and a second electrode of the first pull-up node resetting transistor is connected to the second control voltage end. A control electrode of the second pull-up node resetting transistor is connected to the second pull-down node, a first electrode of the second pull-up node resetting transistor is connected to the pull-up node, and a second electrode of the second pull-up node resetting transistor is connected to the first control voltage end.

In a possible embodiment of the present disclosure, the pull-down node resetting circuit includes a first pull-down node resetting transistor and a second pull-down node resetting transistor. A control electrode of the first pull-down node resetting transistor is connected to the resetting end, a first electrode of the first pull-down node resetting transistor is connected to the first pull-down node, and a second electrode of the first pull-down node resetting transistor is connected to the first level end. A control electrode of the second pull-down node resetting transistor is connected to the resetting end, a first electrode of the second pull-down node resetting transistor is connected to the second pull-down node, and a second electrode of the second pull-down node resetting transistor is connected to the first level end.

In a possible embodiment of the present disclosure, the first pull-down node control circuit is further connected to a first pull-down control node, the first control voltage end and a first voltage end, and configured to control a potential at the first pull-down control node under the control of a first control voltage signal from the first control voltage end and the potential at the pull-up node, and control the first control voltage end to be electrically connected to the first pull-down node under the control of a potential at the first pull-down control node. The second pull-down node control circuit is further connected to a second pull-down control node, the second control voltage end and the first voltage end, and configured to control a potential at the second pull-down control node under the control of a second control voltage signal from the second control voltage end and the potential at the pull-up node, and control the second control voltage end to be electrically connected to the second pull-down node under the control of a potential at the second pull-down control node.

In a possible embodiment of the present disclosure, the first pull-down node control circuit further includes a first control transistor, a second control transistor and a third control transistor. A control electrode and a first electrode of the first control transistor are connected to the first control voltage end, and a second electrode of the first control transistor is connected to the first pull-down control node. A control electrode of the second control transistor is connected to the pull-up node, a first electrode of the second control transistor is connected to the first pull-down control node, and a second electrode of the second control transistor is connected to the first voltage end. A control electrode of the third control transistor is connected to the first pull-down control node, a first electrode of the third control transistor is connected to the first control voltage end, and a second electrode of the third control transistor is connected to the first pull-down node.

In a possible embodiment of the present disclosure, the second pull-down node control circuit further includes a fourth control transistor, a fifth control transistor and a sixth control transistor. A control electrode and a first electrode of the fourth control transistor are connected to the second control voltage end, and a second electrode of the fourth control transistor is connected to the second pull-down control node. A control electrode of the fifth control transistor is connected to the pull-up node, a first electrode of the fifth control transistor is connected to the second pull-down control node, and a second electrode of the fifth control transistor is connected to the first voltage end. A control electrode of the sixth control transistor is connected to the second pull-down control node, a first electrode of the sixth control transistor is connected to the second control voltage end, and a second electrode of the sixth control transistor is connected to the second pull-down node.

In a possible embodiment of the present disclosure, the gate driving unit further includes a gate driving signal output end, a gate driving signal output circuit and a gate driving signal resetting circuit. The gate driving signal output circuit is connected to the pull-up node, a clock signal end and the gate driving signal output end, and configured to control the gate driving signal output end to be electrically connected to the clock signal end under the control of the potential at the pull-up node. The gate driving signal resetting circuit is connected to the first pull-down node, the second pull-down node, the gate driving signal output end and a second voltage end, and configured to control the gate driving signal output end to be electrically connected to the second voltage end under the control of the potential at the first pull-down node, and control the gate driving signal output end to be electrically connected to the second voltage end under the control of the potential at the second pull-down node.

In a possible embodiment of the present disclosure, the gate driving signal output circuit includes a gate driving signal output transistor, and the gate driving signal resetting circuit includes a first gate driving signal resetting transistor and a second gate driving signal resetting transistor. A control electrode of the gate driving signal output transistor is connected to the pull-up node, a first electrode of the gate driving signal output transistor is connected to the clock signal end, and a second electrode of the gate driving signal output transistor is connected to the gate driving signal output end. A control electrode of the first gate driving signal resetting transistor is connected to the first pull-down node, a first electrode of the first gate driving signal resetting transistor is connected to the gate driving signal output end, and a second electrode of the first gate driving signal resetting transistor is connected to the second voltage end. A control electrode of the second gate driving signal resetting transistor is connected to the second pull-down node, a first electrode of the second gate driving signal resetting transistor is connected to the gate driving signal output end, and a second electrode of the second gate driving signal resetting transistor is connected to the second voltage end.

In a possible embodiment of the present disclosure, the gate driving unit further includes a carry signal output end, a carry signal output circuit and a carry signal resetting circuit. The carry signal output circuit is connected to the pull-up node, the clock signal end and the carry signal output end, and configured to control the carry signal output end to be electrically connected to the clock signal end under the control of the potential at the pull-up node. The carry signal resetting circuit is connected to the first pull-down node, the second pull-down node, the carry signal output end and a third voltage end, and configured to control the carry signal output end to be electrically connected to the third voltage end under the control of the potential at the first pull-down node, and control the carry signal output end to be electrically connected to the third voltage end under the control of the potential at the second pull-down node.

In a possible embodiment of the present disclosure, the carry signal output circuit includes a carry signal output transistor, and the carry signal resetting circuit includes a first carry signal resetting transistor and a second carry signal resetting transistor. A control electrode of the carry signal output transistor is connected to the pull-up node, a first electrode of the carry signal output transistor is connected to the clock signal end, and a second electrode of the carry signal output transistor is connected to the carry signal output end. A control electrode of the first carry signal resetting transistor is connected to the first pull-down node, a first electrode of the first carry signal resetting transistor is connected to the carry signal output end, and a second electrode of the first carry signal resetting transistor is connected to the third voltage end. A control electrode of the second carry signal resetting transistor is connected to the second pull-down node, a first electrode of the second carry signal resetting transistor is connected to the carry signal output end, and a second electrode of the second carry signal resetting transistor is connected to the third voltage end.

In a possible embodiment of the present disclosure, the gate driving unit further includes a pull-up node control circuit connected to the pull-up node, an input end, a resetting end, a frame start control end and a fourth voltage end, and configured to control the pull-up node to be electrically connected to the input end under the control of an input signal from the input end, control the pull-up node to be electrically connected to the fourth voltage end under the control of a resetting signal from the resetting end, control the pull-up node to be electrically connected to the fourth voltage end under the control of a frame start control signal from the frame start control end, and maintain the potential at the pull-up node.

In another aspect, the present disclosure provides in some embodiments a gate driving method for the above-mentioned gate driving unit. A driving time includes a plurality of voltage output periods, and each voltage output period includes a first voltage output stage and a second voltage output stage arranged sequentially. The first voltage output stage includes at least one display period, and the second voltage output stage includes at least one display period. Each display period includes an input time period, an output time period, a resetting time period and an output cutoff maintenance time period. The gate driving method includes: at the first voltage output stage, enabling the first control voltage end to input an active voltage, and enabling the second control voltage end to input an inactive voltage; at the second voltage output stage, enabling the first control voltage to input an inactive voltage and enabling the second control voltage end to input an active voltage; within the input time period and the output time period of the first voltage output stage, enabling a potential at the pull-up node to be the active voltage, controlling, by the first pull-down node control circuit, a potential at the first pull-down node to be the inactive voltage, and controlling, by the second pull-down node control circuit, a potential at the second pull-down node to be the inactive voltage; within the output cutoff maintenance time period and the resetting time period of the first voltage output stage and the resetting time period and the output cutoff maintenance time period of the second voltage output stage, enabling the potential at the pull-up node to be the inactive voltage, controlling, by the first pull-down node control circuit, the first pull-down node to be electrically disconnected from the second control voltage end, and controlling, by the second pull-down node control circuit, the second pull-down node to be electrically disconnected from the first control voltage end; within the output cutoff maintenance time period of the first voltage output stage, controlling, by the first pull-down node control circuit, the potential at the first pull-down node to be the active voltage, controlling, by the second pull-down node control circuit, the potential at the second pull-down node to be the inactive voltage, controlling, by the pull-up node resetting circuit, the pull-up node to be electrically connected to the second control voltage end under the control of the potential at the first pull-down node, and controlling, by the pull-up node resetting circuit, the pull-up node to be electrically disconnected from the first control voltage end under the control of the potential at the second pull-down node; and within the output cutoff maintenance time period of the second voltage output stage, controlling, by the first pull-down node control circuit, the potential at the first pull-down node to be the inactive voltage, controlling, by the second pull-down node control circuit, the potential at the second pull-down node to be the active voltage, controlling, by the pull-up node resetting circuit, the pull-up node to be electrically connected to the first control voltage end under the control of the potential at the second pull-down node, and controlling, by the pull-up node resetting circuit, the pull-up node to be electrically disconnected from the second control voltage end under the control of the potential at the first pull-down node.

In a possible embodiment of the present disclosure, the gate driving unit further includes a pull-down node resetting circuit. The gate driving method further includes, within the resetting time period of the first voltage output stage and the resetting time period of the second voltage output stage, controlling, by the pull-down node resetting circuit, the first pull-down node and the second pull-down node to be electrically connected to the first level end under the control of a resetting signal from the resetting end, so as to enable the potential at the first pull-down node and the potential at the second pull-down node to be each the inactive voltage.

In a possible embodiment of the present disclosure, the gate driving unit further includes a gate driving signal output circuit, a gate driving signal resetting circuit, a carry signal output circuit and a carry signal resetting circuit. The first pull-down node control circuit and the second pull-down node control circuit are connected to the first voltage end, the gate driving signal output circuit and the carry signal output circuit are connected to the clock signal end, the gate driving signal resetting circuit is connected to the second voltage end, and the carry signal resetting circuit is connected to the third voltage end. A transistor included in the first pull-down node control circuit, a transistor included in the second pull-down node control circuit, a transistor included in the gate driving signal output circuit, a transistor included in the gate driving signal resetting circuit, a transistor included in the carry signal output circuit and a transistor included in the carry signal resetting circuit are all n-type transistors. The inactive voltage inputted by the first control voltage end and the inactive voltage inputted by the second control voltage end are each a low level Vgl which is smaller than a first voltage from the first voltage end, smaller than a second voltage inputted by the second voltage end and smaller than a third voltage inputted by the third voltage end.

In a possible embodiment of the present disclosure, the gate driving unit further includes a gate driving signal output circuit, a gate driving signal resetting circuit, a carry signal output circuit and a carry signal resetting circuit. The first pull-down node control circuit and the second pull-down node control circuit are connected to the first voltage end, the gate driving signal output circuit and the carry signal output circuit are connected to the clock signal end, the gate driving signal resetting circuit is connected to the second voltage end, and the carry signal resetting circuit is connected to the third voltage end. A transistor included in the first pull-down node control circuit, a transistor included in the second pull-down node control circuit, a transistor included in the gate driving signal output circuit, a transistor included in the gate driving signal resetting circuit, a transistor included in the carry signal output circuit and a transistor included in the carry signal resetting circuit are all p-type transistors. The inactive voltage inputted by the first control voltage end and the inactive voltage inputted by the second control voltage end are each a high level Vgh which is larger than a first voltage from the first voltage end, larger than a second voltage inputted by the second voltage end and larger than a third voltage inputted by the third voltage end.

In yet another aspect, the present disclosure provides in some embodiments a gate driving circuit including a plurality of levels of the above-mentioned gate driving units.

In still yet another aspect, the present disclosure provides in some embodiments a display device including the above-mentioned gate driving circuit.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be triodes, TFTs, field effect transistors (FETs) or any other elements having an identical characteristic. In order to differentiate two electrodes other than a control electrode from each other, one of the two electrodes is called a first electrode and the other is called a second electrode.

In actual use, when the transistor is a triode, the control electrode may be a base, the first electrode may be a collector, and the second electrode may be an emitter, or the control electrode may be a base, the first electrode may be an emitter, and the second electrode may be a collector.

In actual use, when the transistor is a TFT or FET, the control electrode may be a gate electrode, the first electrode may be a drain electrode and the second electrode may be a source electrode, or the control electrode may be a gate electrode, the first electrode may be a source electrode and the second electrode may be a drain electrode.

In the related art, a characteristic of each transistor of a GOA circuit is deteriorated due to a driving stress applied continuously in a same direction. When serious drift occurs for a threshold voltage of the transistor, a charging/discharging capability of a pull-up node may be adversely affected, resulting in an output abnormality for a gate driving unit.

Depending on the characteristic of the GOA circuit, when a gate electrode voltage Vg applied to a TFT is small and each of a drain electrode voltage Vd and a source electrode voltage Vs is obviously greater than the gate electrode voltage Vg, the TFT may not be turned on. At this time, a stress may be applied in a reverse direction to the TFT, and a threshold voltage of the TFT may drift backward.

An object of the present disclosure is to provide a gate driving unit, a gate driving method, a gate driving circuit and a display device, so as to improve the drift of the threshold voltage of the TFT in the gate driving unit and prevent the charging/discharging capability of the pull-up node PU from being adversely affected, thereby to prevent the occurrence of the output abnormality for the gate driving unit.

Figure 1:
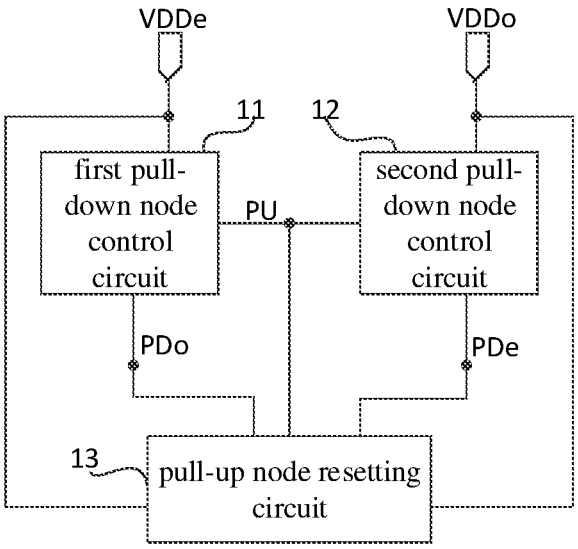
FIG. 1 is a schematic view showing a gate driving unit according to one embodiment of the present disclosure.

The present disclosure provides in some embodiments a gate driving unit which, as shown in FIG. 1, includes a first pull-down node control circuit 11, a second pull-down node control circuit 12 and a pull-up node resetting circuit 13. The first pull-down node control circuit 11 is connected to a pull-up node PU, a first pull-down node PDo and a second control voltage end VDDe, and configured to control the first pull-down node PDo to be electrically connected to, or electrically disconnected from, the second control voltage end VDDe under the control of a potential at the pull-up node PU, the second control voltage end VDDe inputs a second control voltage. The second pull-down node control circuit 12 is connected to the pull-up node PU, a second pull-down node PDe and a first control voltage end VDDo, and configured to control the second pull-down node PDe to be electrically connected to, or electrically disconnected from, the first control voltage end VDDo under the control of the potential at the pull-up node PU, the first control voltage end VDDo inputs a first control voltage. The pull-up node resetting circuit 13 is connected to the first pull-down node PDo, the second pull-down node PDe, the pull-up node PU, the first control voltage end VDDo and the second control voltage end VDDe, and configured to control the pull-up node PU to be electrically connected to the second control voltage end VDDe under the control of a potential at the first pull-down node PDo, and control the pull-up node PU to be electrically connected to the first control voltage end VDDo under the control of a potential at the second pull-down node PDe.

During the operation of the gate driving unit in FIG. 1, a driving time may include a plurality of voltage output periods, and each voltage output period may include a first voltage output stage and a second voltage output stage arranged sequentially. At the first voltage output stage, the first control voltage end VDDo may input an active voltage, and the second control voltage end VDDe may input an inactive voltage. At the second voltage output stage, the first control voltage end VDDo may input the inactive voltage, and the second control voltage end VDDe may input the active voltage.

During the implementation, the first voltage output stage may include at least one display period (the display period may be a duration for displaying a frame of image), and the second voltage output stage may include at least one display period (the display period may be a duration for displaying a frame of image). Each display period may include an input time period, an output time period, a resetting time period and an output cutoff maintenance time period arranged sequentially. Within the input time period and the output time period, the potential at the pull-up node PU may be the active voltage. Within the output time period, the gate driving unit may be connected to a clock signal end via a gate driving signal output end under the control of the potential at the pull-up node PU. Within the resetting time period and the output cutoff maintenance time period, the gate driving unit may output the inactive voltage through the gate driving signal output end.

In actual use, a duration of the first voltage output stage and a duration of the second voltage output stage may each be, but are not limited to, 2*s*.

To be specific, the active voltage is a voltage capable of turning on a transistor when the voltage is applied to a gate electrode of the transistor. For example, when the transistor is an n-type transistor, the active voltage may be a high voltage, and when the transistor is a p-type transistor, the active voltage may be a low voltage. However, the active voltage may not be limited thereto.

To be specific, the inactive voltage may be a voltage capable of turning off a transistor when the voltage is applied to a gate electrode of the transistor. For example, when the transistor is an n-type transistor, the inactive voltage may be a low voltage, and when the transistor is a p-type transistor, the inactive voltage may be a high voltage. However, the inactive voltage may not be limited thereto.

During the operation of the gate driving unit in FIG. 1, the first voltage output stage may include at least one display period, and the second voltage output stage may include at least one display period. Each display period may include an input time period, an output time period, a resetting time period and an output cutoff maintenance time period.

Within the input time period and the output time period of the first voltage output stage, the potential at the pull-up node PU may be the active voltage, the first pull-down node control circuit 11 may control the potential at the first pull-down node PDo to be the inactive voltage, and the second pull-down node control circuit 12 may control the potential at the second pull-down node PDe to be the inactive voltage. At this time, because the active voltage is inputted by VDDo, a stress may be applied in a reverse direction to a transistor of the second pull-down node control circuit 12, so it is able to prevent a threshold voltage of the transistor from being drifted.

Within the input time period and the output time period of the second voltage output stage, the potential at the pull-up node PU may be the active voltage, the first pull-down node control circuit 11 may control the potential at the first pull-down node PDo to be the inactive voltage, and the second pull-down node control circuit 12 may control the potential at the second pull-down node PDe to be the inactive voltage. At this time, because the active voltage is inputted by VDDe, a stress may be applied in a reverse direction to a transistor of the first pull-down node control circuit 11, so it is able to prevent a threshold voltage of the transistor from being drifted.

Within the resetting time period and the output cutoff maintenance time period of the first voltage output stage and within the resetting time period and the output cutoff maintenance time period of the second voltage output stage, the potential at the pull-up node PU may be the inactive voltage, the first pull-down node control circuit 11 may control the first pull-down node PDo to be electrically disconnected from the second control voltage end VDDe, and the second pull-down node control circuit 12 may control the second pull-down node PDe to be electrically disconnected from the first control voltage end VDDo. Within the resetting time period, the potential at PU may be the inactive voltage. When the active voltage is inputted by VDDo, a stress may be applied in a reverse direction to the transistor of the second pull-down node control circuit 12. When the active voltage is inputted by VDDe, a stress may be applied in a reverse direction to the transistor of the first pull-down node control circuit 11.

Within the output cutoff maintenance time period of the first voltage output stage, the first pull-down node control circuit 11 may control the potential at the first pull-down node PDo to be the active voltage, and the second pull-down node control circuit 12 may control the potential at the second pull-down node PDe to be the inactive voltage. The pull-up node resetting circuit 13 may control the pull-up node PU to be electrically connected to the second control voltage end VDDe under the control of the potential at the first pull-down node PDo, so as to enable the potential at the pull-up node PU to be the inactive voltage. The pull-up node resetting circuit 13 may control the pull-up node PU to be electrically disconnected from the first control voltage end VDDo under the control of the potential at the second pull-down node PDe. At this time, the active voltage may be inputted by VDDo, and the inactive voltage may be inputted by VDDe, so the potential at PU may be the inactive voltage, the potential at PDo may be the active voltage, and the potential at PDe may be the inactive voltage. At this time, a stress may be applied in a reserve direction to the transistor of the second pull-down node control circuit 12 and the transistor of the pull-up node resetting circuit 13 whose gate electrode is connected to the second pull-down node PDe. As a result, it is able to prevent the threshold voltage of the transistor from being drifted and prevent a charging/discharging capability of the pull-up node from being adversely affected, thereby to prevent the occurrence of an output abnormality for the gate driving unit.

Within the output cutoff maintenance time period of the second voltage output stage, the first pull-down node control circuit 11 may control the potential at the first pull-down node PDo to be the inactive voltage, and the second pull-down node control circuit 12 may control the potential at the second pull-down node PDe to be the active voltage. The pull-up node resetting circuit 13 may control the pull-up node PU to be electrically connected to the first control voltage end VDDo under the control of the potential at the second pull-down node PDe. The pull-up node resetting circuit 13 may control the pull-up node PU to be electrically disconnected from the second control voltage end VDDe under the control of the potential at the first pull-down node PDo. At the second voltage output stage, the inactive voltage may be inputted by VDDo, and the active voltage may be inputted by VDDe, so the potential at PU may be the inactive voltage, the potential at PDo may be the inactive voltage, and the potential at PDe may be the active voltage. At this time, a stress may be applied in a reverse direction to the transistor of the first pull-down node control circuit 11, and a stress may be applied in a reserve direction to a transistor of the pull-up node resetting circuit 13 whose gate electrode is connected to the first pull-down node PDo. As a result, it is able to prevent the threshold voltage of each transistor from being drifted and prevent the charging/discharging capability of the pull-up node from being adversely affected, thereby to prevent the occurrence of the output abnormality for the gate driving unit.

According to the embodiments of the present disclosure, it is able to recover a characteristic of the transistor during the operation and at a time interval between operations of the transistor, thereby to prolong a service life of a result display product.

Figure 2:
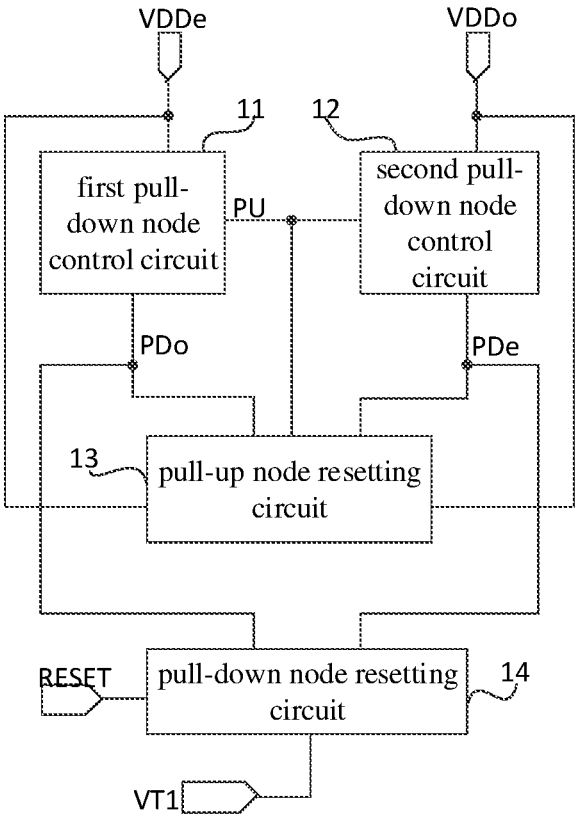
FIG. 2 is another schematic view showing the gate driving unit according to one embodiment of the present disclosure.

During the implementation, as shown in FIG. 2, on the basis of the gate driving unit in FIG. 1, the gate driving unit may further include a pull-down node resetting circuit 14 connected to a resetting end RESET, the first pull-down node PDo, the second pull-down node PDe and a first level end VT1, and configured to, under the control of a resetting signal from the resetting end RESET, control the first pull-down node PDo to be electrically connected to the first level end VT1, and control the second pull-down node PDe to be electrically connected to the first level end VT1.

During the implementation, the first level end VT1 may be, but is not limited to, a low level end.

During the operation of the gate driving unit in FIG. 2, within the resetting time period of the first voltage output stage and the resetting time period of the second voltage output stage, the potential at the pull-up node PU may be the inactive voltage. The pull-down node resetting circuit 14 may control the first pull-down node PDo to be electrically connected to the first level end VT1 and control the second pull-down node PDe to be electrically connected to the first level end VT1 under the control of the resetting signal from the resetting end RESET, so as to enable each of the potential at the first pull-down node PDo and the potential at the second pull-down node PDe to be the inactive voltage. For the gate driving unit in the embodiments of the present disclosure, the potential at PDo and the potential at PDe may be reset through the pull-down node resetting circuit 14 at the resetting stage, so as to prevent the occurrence of such a situation where the potential at PU cannot be reset when the pull-up node PU is charged by the pull-up node resetting circuit 13 under the control of the potential at the pull-down node within the resetting time period, thereby to perform noise reduction on the potential at the pull-up node PU.

In addition, during the operation of the gate driving unit in FIG. 2, within the resetting time period, the potential at the pull-up node PU may be the inactive voltage, the first pull-down node control circuit 11 may control the first pull-down node PDo to be electrically disconnected from the second control voltage end VDDe, and the second pull-down node control circuit 12 may control the second pull-down node PDe to be electrically disconnected from the first control voltage end VDDo.

In addition, during the operation of the gate driving unit in FIG. 2, each of the potential at PDo and the potential at PDe may be the inactive voltage.

At the first voltage output stage, VDDo may input the active voltage. A stress may be applied in a reverse direction to the transistor of the second pull-down node control circuit 12, and a stress may be applied in a reverse direction to the transistor of the pull-up node resetting circuit 13 whose gate electrode is connected to the second pull-down node PDe, so as to prevent the threshold voltage of each transistor from being drifted, thereby to prevent the occurrence of the output abnormality for the gate driving unit.

At the second voltage output stage, VDDe may input the active voltage. A stress may be applied in a reverse direction to the transistor of the first pull-down node control circuit 11, and a stress may be applied in a reverse direction to the transistor of the pull-up node resetting circuit 13 whose gate electrode is connected to the first pull-down node PDo, so as to prevent the threshold voltage of each transistor from being drifted, thereby to prevent the occurrence of the output abnormality for the gate driving unit.

To be specific, the first pull-down node control circuit may include a first pull-down node control transistor, a control electrode of which is connected to the pull-up node, a first electrode of which is connected to the first pull-down node, and a second electrode of which is connected to the second control voltage end. The second pull-down node control circuit may include a second pull-down node control transistor, a control electrode of which is connected to the pull-up node, a first electrode of which is connected to the second pull-down node, and a second electrode of which is connected to the first control voltage end.

Figure 3:
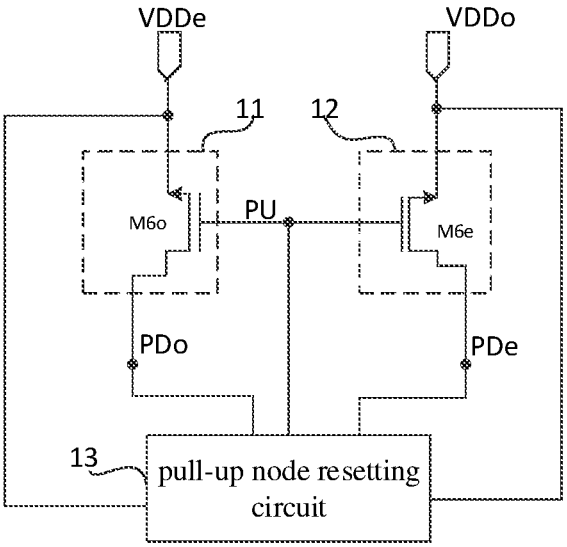
FIG. 3 is yet another schematic view showing the gate driving unit according to one embodiment of the present disclosure.

As shown in FIG. 3, on the basis of the gate driving unit in FIG. 1, the first pull-down node control circuit 11 may include a first pull-down node control transistor M6*o*, a gate electrode of which is connected to the pull-up node PU, a drain electrode of which is connected to the first pull-down node PDo, and a source electrode of which is connected to the second control voltage end VDDe. The second pull-down node control circuit 12 may include a second pull-down node control transistor M6*e*, a gate electrode of which is connected to the pull-up node PU, a drain electrode of which is connected to the second pull-down node PDe, and a source electrode of which is connected to the first control voltage end VDDo.

In FIG. 3, M6*o* and M6*e* may each be, but are not limited to, an n-type transistor.

During the operation of the gate driving unit in FIG. 3, when the potential at PU is a high voltage, M6*o* and M6*e* may be turned on, so as to control PDo to be electrically connected to VDDe, and control PDe to be electrically connected to VDDo. Hence, at the first voltage output stage, the potential at PDo may be the active voltage and the potential at PDe may be the inactive voltage, and at the second voltage output stage, the potential at PDe may be the active voltage and the potential at PDo may be the inactive voltage.

During the implementation, the pull-up node resetting circuit may include a first pull-up node resetting transistor and a second pull-up node resetting transistor. A control electrode of the first pull-up node resetting transistor is connected to the first pull-down node, a first electrode of the first pull-up node resetting transistor is connected to the pull-up node, and a second electrode of the first pull-up node resetting transistor is connected to the second control voltage end. A control electrode of the second pull-up node resetting transistor is connected to the second pull-down node, a first electrode of the second pull-up node resetting transistor is connected to the pull-up node, and a second electrode of the second pull-up node resetting transistor is connected to the first control voltage end.

Figure 4:
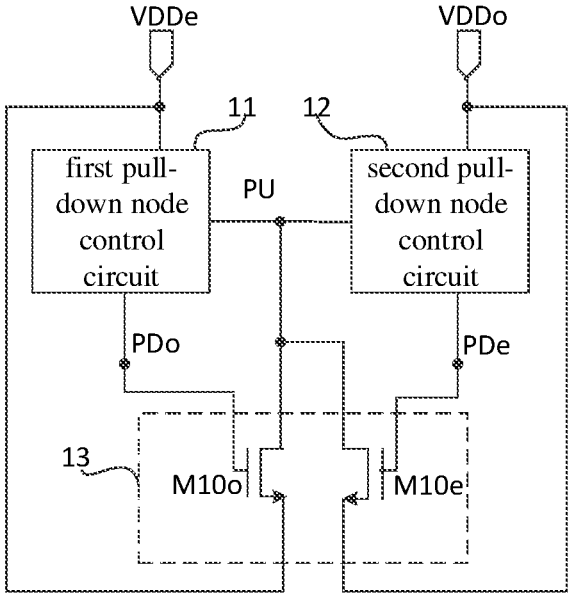
FIG. 4 is still yet another schematic view showing the gate driving unit according to one embodiment of the present disclosure.

As shown in FIG. 4, on the basis of the gate driving unit in FIG. 1, the pull-up node resetting circuit 13 may include a first pull-up node resetting transistor M10*o* and a second pull-up node resetting transistor M10*e*. A gate electrode of the first pull-up node resetting transistor M10*o* may be connected to the first pull-down node PDo, a drain electrode of the first pull-up node resetting transistor M10*o* may be connected to the pull-up node PU, and a source electrode of the first pull-up node resetting transistor M10*o* may be connected to the second control voltage end VDDe. A gate electrode of the second pull-up node resetting transistor M10*e* may be connected to the second pull-down node PDe, a drain electrode of the second pull-up node resetting transistor M10*e* may be connected to the pull-up node PU, and a source electrode of the second pull-up node resetting transistor M10*e* may be connected to the first control voltage end VDDo.

In FIG. 4, M10*o* and M10*e* may each be, but are not limited to, an n-type transistor.

During the operation of the gate driving unit in FIG. 4, when the potential at PDo is the active voltage, M10*o* may be turned on so as to control PU to be electrically connected to VDDe. When the potential at PDe is the active voltage, PU may be electrically connected to VDDo.

To be specific, the pull-down node resetting circuit may include a first pull-down node resetting transistor and a second pull-down node resetting transistor. A control electrode of the first pull-down node resetting transistor is connected to the resetting end, a first electrode of the first pull-down node resetting transistor is connected to the first pull-down node, and a second electrode of the first pull-down node resetting transistor is connected to the first level end. A control electrode of the second pull-down node resetting transistor is connected to the resetting end, a first electrode of the second pull-down node resetting transistor is connected to the second pull-down node, and a second electrode of the second pull-down node resetting transistor is connected to the first level end.

Figure 5:
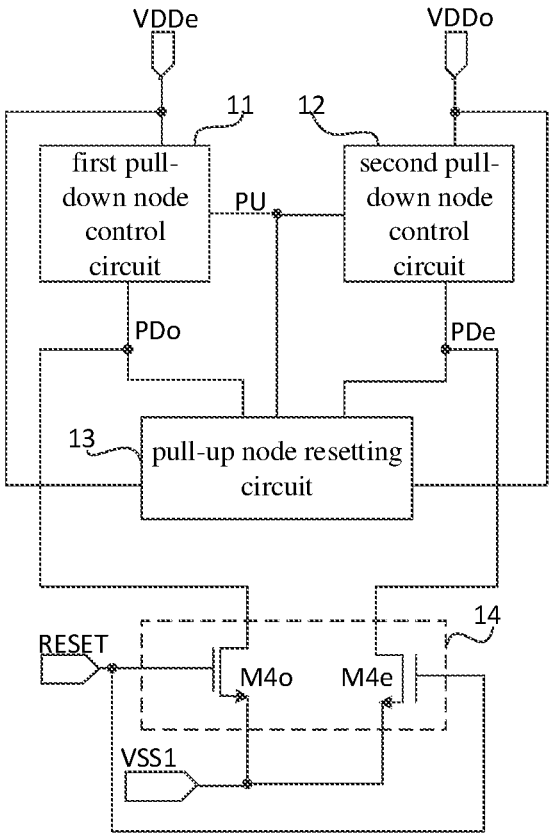
FIG. 5 is still yet another schematic view showing the gate driving unit according to one embodiment of the present disclosure.

As shown in FIG. 5, on the basis of the gate driving unit in FIG. 2, the pull-down node resetting circuit 14 may include a first pull-down node resetting transistor M4*o* and a second pull-down node resetting transistor M4*e*. A gate electrode of the first pull-down node resetting transistor M4*o* may be connected to the resetting end RESET, a drain electrode of the first pull-down node resetting transistor M4*o* may be connected to the first pull-down node PDo, and a source electrode of the first pull-down node resetting transistor M4*o* may be connected to a first voltage end. The first low voltage end is configured to input a first low voltage VSS1. A gate electrode of the second pull-down node resetting transistor M4*e* may be connected to the resetting end RESET, a drain electrode of the second pull-down node resetting transistor M4*e* may be connected to the second pull-down node PDe, and a source electrode of the second pull-down node resetting transistor M4*e* may be connected to the first low voltage end.

In FIG. 5, the first level end may be, but is not limited to, the first low voltage end. M4*o* and M4*e* may each be, but are not limited to, an n-type transistor.

During the operation of the gate driving unit in FIG. 5, within the resetting time period, RESET may input a high level, so as to turn on M4*o* and M4*e*, thereby to control the potential at PDo and the potential at PDe to be each VSS1.

To be specific, the first pull-down node control circuit may be further connected to a first pull-down control node, the first control voltage end and a first voltage end, and configured to control a potential at the first pull-down control node under the control of a first control voltage signal from the first control voltage end and the potential at the pull-up node, and control the first control voltage end to be electrically connected to the first pull-down node under the control of a potential at the first pull-down control node. The second pull-down node control circuit may be further connected to a second pull-down control node, the second control voltage end and the first voltage end, and configured to control a potential at the second pull-down control node under the control of a second control voltage signal from the second control voltage end and the potential at the pull-up node, and control the second control voltage end to be electrically connected to the second pull-down node under the control of a potential at the second pull-down control node.

Figure 6:
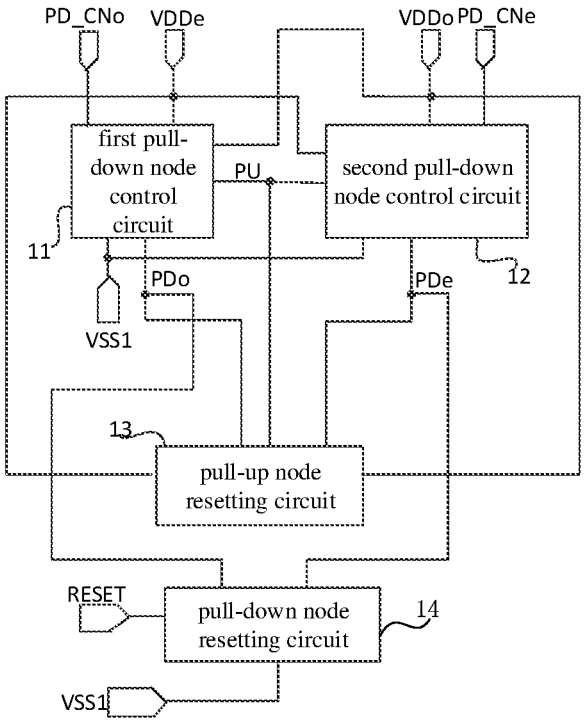
FIG. 6 is still yet another schematic view showing the gate driving unit according to one embodiment of the present disclosure.

During the implementation, on the basis of the gate driving unit in FIG. 2, as shown in FIG. 6, the first pull-down node control circuit 11 may be further connected to the first pull-down control node PD_CNo, the first control voltage end VDDo and the first low voltage end, and configured to control the potential at the first pull-down control node PD_CNo under the control of the first control voltage signal from the first control voltage end VDDo and the potential at the pull-up node PU, and control the first control voltage end VDDo to be electrically connected to the first pull-down node PDo under the control of the potential at the first pull-down control node PD_CNo, where the first low voltage end is used to input a first low voltage VSS1. The second pull-down node control circuit 12 may be further connected to the second pull-down control node PD_CNe, the second control voltage end VDDe and the first low voltage end, and configured to control the potential at the second pull-down control node PD_CNe under the control of the second control voltage signal from the second control voltage end VDDe and the potential at the pull-up node PU, and control the second control voltage end VDDe to be electrically connected to the second pull-down node PDe under the control of the potential at the second pull-down control node PD_CNe.

In FIG. 6, the first voltage end may be, but is not limited to, the first low voltage end. The first level end may be, but is not limited to, the first low voltage end.

During the implementation, the first pull-down node control circuit 11 is configured to control the potential at the first pull-down node PDo under the control of the first control voltage inputted by VDDo and the potential at PU, and the second pull-down node control circuit 12 is configured to control the potential at the second pull-down node PDe under the control of the second control voltage inputted by VDDe and the potential at PU.

To be specific, the first pull-down node control circuit may further include a first control transistor, a second control transistor and a third control transistor. A control electrode and a first electrode of the first control transistor may be connected to the first control voltage end, and a second electrode of the first control transistor may be connected to the first pull-down control node. A control electrode of the second control transistor may be connected to the pull-up node, a first electrode of the second control transistor may be connected to the first pull-down control node, and a second electrode of the second control transistor may be connected to the first voltage end. A control electrode of the third control transistor may be connected to the first pull-down control node, a first electrode of the third control transistor may be connected to the first control voltage end, and a second electrode of the third control transistor may be connected to the first pull-down node.

During the implementation, when the second control transistor is an n-type transistor, the control electrode of the second control transistor may be connected to the pull-up node, and the second electrode of the second control transistor may be connected to the first voltage end. Within the output cutoff maintenance time period, the potential at the pull-up node may be reset by the pull-up node resetting circuit to be a low level Vgl which is smaller than the first voltage inputted by the first voltage end. Hence, within the output cutoff maintenance time period, a gate-to-source voltage of the second control transistor may be smaller than 0, so a stress may be applied in a reverse direction to the second control transistor. In this way, it is able to prevent a threshold voltage of the second control transistor from being drifted.

During the implementation, when the second control transistor is a p-type transistor, the control electrode of the second control transistor may be connected to the pull-up node, and the second electrode of the second control transistor may be connected to the first voltage end. Within the output cutoff maintenance time period, the potential at the pull-up node may be reset by the pull-up node resetting circuit to a high level Vgh which is greater than the first voltage inputted by the first voltage end. Hence, within the output cutoff maintenance time period, the gate-to-source voltage of the second control transistor may be greater than 0, so a stress may be applied in a reverse direction to the second control transistor. In this way, it is able to prevent the threshold voltage of the second control transistor from being drifted.

To be specific, the second pull-down node control circuit may further include a fourth control transistor, a fifth control transistor and a sixth control transistor. A control electrode and a first electrode of the fourth control transistor may be connected to the second control voltage end, and a second electrode of the fourth control transistor may be connected to the second pull-down control node. A control electrode of the fifth control transistor may be connected to the pull-up node, a first electrode of the fifth control transistor may be connected to the second pull-down control node, and a second electrode of the fifth control transistor may be connected to the first voltage end. A control electrode of the sixth control transistor may be connected to the second pull-down control node, a first electrode of the sixth control transistor may be connected to the second control voltage end, and a second electrode of the sixth control transistor may be connected to the second pull-down node.

During the implementation, when the fifth control transistor is an n-type transistor, the control electrode of the fifth control transistor may be connected to the pull-up node, and the second electrode of the fifth control transistor may be connected to the first voltage end. Within the output cutoff maintenance time period, the potential at the pull-up node may be reset by the pull-up node resetting circuit to be the low level Vgl which is smaller than the first voltage inputted by the first voltage end. Hence, within the output cutoff maintenance time period, a gate-to-source voltage of the fifth control transistor may be smaller than 0, so a stress may be applied in a reverse direction to the fifth control transistor. In this way, it is able to prevent a threshold voltage of the fifth control transistor from being drifted.

During the implementation, when the fifth control transistor is a p-type transistor, the control electrode of the fifth control transistor may be connected to the pull-up node, and the second electrode of the fifth control transistor may be connected to the first voltage end. Within the output cutoff maintenance time period, the potential at the pull-up node may be reset by the pull-up node resetting circuit to the high level Vgh which is greater than the first voltage inputted by the first voltage end. Hence, within the output cutoff maintenance time period, the gate-to-source voltage of the fifth control transistor may be greater than 0, so a stress may be applied in a reverse direction to the fifth control transistor. In this way, it is able to prevent the threshold voltage of the fifth control transistor from being drifted.

During the implementation, the gate driving unit may further include a gate driving signal output end, a gate driving signal output circuit and a gate driving signal resetting circuit. The gate driving signal output circuit may be connected to the pull-up node, a clock signal end and the gate driving signal output end, and configured to control the gate driving signal output end to be electrically connected to the clock signal end under the control of the potential at the pull-up node. The gate driving signal resetting circuit may be connected to the first pull-down node, the second pull-down node, the gate driving signal output end and a second voltage end, and configured to control the gate driving signal output end to be electrically connected to the second voltage end under the control of the potential at the first pull-down node, and control the gate driving signal output end to be electrically connected to the second voltage end under the control of the potential at the second pull-down node.

Figure 7:
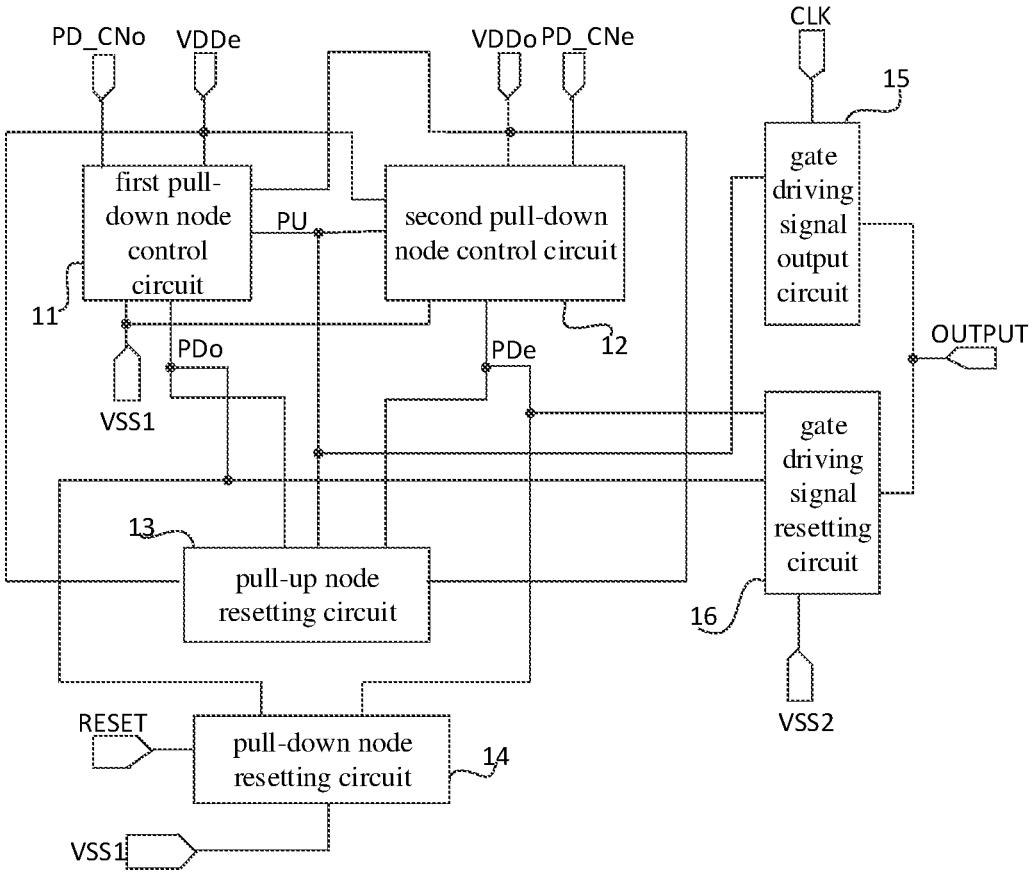
FIG. 7 is still yet another schematic view showing the gate driving unit according to one embodiment of the present disclosure.

As shown in FIG. 7, on the basis of the gate driving unit in FIG. 6, the gate driving unit may further include a gate driving signal output end OUTPUT, a gate driving signal output circuit 15 and a gate driving signal resetting circuit 16. The gate driving signal output circuit 15 may be connected to the pull-up node PU, a clock signal end CLK and the gate driving signal output end OUTPUT, and configured to control the gate driving signal output end OUTPUT to be electrically connected to the clock signal end CLK under the control of the potential at the pull-up node PU. The gate driving signal resetting circuit 16 may be connected to the first pull-down node PDo, the second pull-down node PDe, the gate driving signal output end OUTPUT and a second low voltage end, and configured to control the gate driving signal output end OUTPUT to be electrically connected to the second low voltage end under the control of the potential at the first pull-down node PDo, and control the gate driving signal output end OUTPUT to be electrically connected to the second low voltage end under the control of the potential at the second pull-down node PDe. The second low voltage end is configured to input a second low voltage VSS2.

In FIG. 7, the second voltage end may be, but is not limited to, the second low voltage end.

During the operation of the gate driving unit in FIG. 7, the gate driving signal output circuit 15 may control OUTPUT to be electrically connected to CLK under the potential at PU. The gate driving signal resetting circuit 16 may control OUTPUT to output the inactive voltage under the control of PDo, or control OUTPUT to output the inactive voltage under the control of PDe.

To be specific, the gate driving signal output circuit may include a gate driving signal output transistor, and the gate driving signal resetting circuit may include a first gate driving signal resetting transistor and a second gate driving signal resetting transistor. A control electrode of the gate driving signal output transistor may be connected to the pull-up node, a first electrode of the gate driving signal output transistor may be connected to the clock signal end, and a second electrode of the gate driving signal output transistor may be connected to the gate driving signal output end. A control electrode of the first gate driving signal resetting transistor may be connected to the first pull-down node, a first electrode of the first gate driving signal resetting transistor may be connected to the gate driving signal output end, and a second electrode of the first gate driving signal resetting transistor may be connected to the second voltage end. A control electrode of the second gate driving signal resetting transistor may be connected to the second pull-down node, a first electrode of the second gate driving signal resetting transistor may be connected to the gate driving signal output end, and a second electrode of the second gate driving signal resetting transistor may be connected to the second voltage end.

Within the output cutoff maintenance time period, when the gate driving signal output transistor is an n-type transistor, the potential at the pull-up node may be reset by the pull-up node resetting circuit to be the low level Vgl, and CLK may input a high level and a low level alternately. When CLK inputs a high level, a gate-to-source voltage of the gate driving signal output transistor may be smaller than 0, so a stress may be applied in a reverse direction to the gate driving signal output transistor. In this way, it is able to prevent a threshold voltage of the gate driving signal output transistor from being drifted.

Within the output cutoff maintenance time period, when the gate driving signal output transistor is a p-type transistor, the potential at the pull-up node may be reset by the pull-up node resetting circuit to be the high level Vgh, and CLK may input a high level and a low level alternately. When CLK inputs a low level, a gate-to-source voltage of the gate driving signal output transistor may be greater than 0, so a stress may be applied in a reverse direction to the gate driving signal output transistor. In this way, it is able to prevent a threshold voltage of the gate driving signal output transistor from being drifted.

When the first gate driving signal resetting transistor and the second gate driving signal resetting transistor are each an n-type transistor, within the output cutoff maintenance time period of the first voltage output stage, the potential at the first pull-down node may be the active voltage, and the potential at the second pull-down node may be the low level Vgl which may be smaller than the second voltage inputted by the second voltage end, so a gate-to-source voltage of the second gate driving signal resetting transistor may be smaller than 0, and a stress may be applied in a reverse direction to the second gate driving signal resetting transistor. In this way, it is able to prevent a threshold voltage of the second gate driving signal resetting transistor from being drifted.

When the first gate driving signal resetting transistor and the second gate driving signal resetting transistor are each an n-type transistor, within the output cutoff maintenance time period of the second voltage output stage, the potential at the second pull-down node may be the active voltage, and the potential at the first pull-down node may be the low level Vgl which may be smaller than the second voltage inputted by the second voltage end, so a gate-to-source voltage of the first gate driving signal resetting transistor may be smaller than 0, and a stress may be applied in a reverse direction to the first gate driving signal resetting transistor. In this way, it is able to prevent a threshold voltage of the first gate driving signal resetting transistor from being drifted.

When the first gate driving signal resetting transistor and the second gate driving signal resetting transistor are each a p-type transistor, within the output cutoff maintenance time period of the first voltage output stage, the potential at the first pull-down node may be the active voltage, and the potential at the second pull-down node may be the high level Vgh which may be greater than the second voltage inputted by the second voltage end, so the gate-to-source voltage of the second gate driving signal resetting transistor may be greater than 0, and a stress may be applied in a reverse direction to the second gate driving signal resetting transistor. In this way, it is able to prevent a threshold voltage of the second gate driving signal resetting transistor from being drifted.

When the first gate driving signal resetting transistor and the second gate driving signal resetting transistor are each a p-type transistor, within the output cutoff maintenance time period of the second voltage output stage, the potential at the second pull-down node may be the active voltage, and the potential at the first pull-down node may be the high level Vgh which may be greater than the second voltage inputted by the second voltage end, so the gate-to-source voltage of the first gate driving signal resetting transistor may be greater than 0, and a stress may be applied in a reverse direction to the first gate driving signal resetting transistor. In this way, it is able to prevent a threshold voltage of the first gate driving signal resetting transistor from being drifted.

During the implementation, the gate driving unit may further include a carry signal output end, a carry signal output circuit and a carry signal resetting circuit. The carry signal output circuit may be connected to the pull-up node, the clock signal end and the carry signal output end, and configured to control the carry signal output end to be electrically connected to the clock signal end under the control of the potential at the pull-up node. The carry signal resetting circuit may be connected to the first pull-down node, the second pull-down node, the carry signal output end and a third voltage end, and configured to control the carry signal output end to be electrically connected to the third voltage end under the control of the potential at the first pull-down node, and control the carry signal output end to be electrically connected to the third voltage end under the control of the potential at the second pull-down node.

Figure 8:
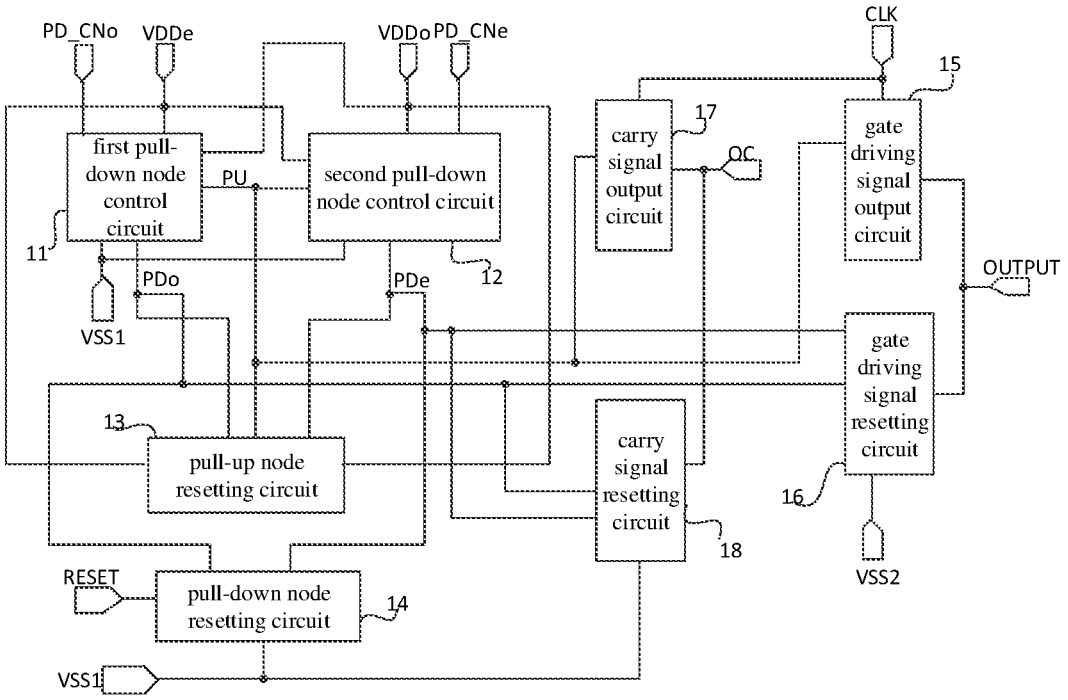
FIG. 8 is still yet another schematic view showing the gate driving unit according to one embodiment of the present disclosure.

As shown in FIG. 8, on the basis of the gate driving unit in FIG. 7, the gate driving unit may further include a carry signal output end OC, a carry signal output circuit 17 and a carry signal resetting circuit 18. The carry signal output circuit 17 may be connected to the pull-up node PU, the clock signal end CLK and the carry signal output end OC, and configured to control the carry signal output end OC to be electrically connected to the clock signal end CLK under the control of the potential at the pull-up node PU. The carry signal resetting circuit 18 may be connected to the first pull-down node PDo, the second pull-down node PDe, the carry signal output end OC and a first low voltage end, and configured to control the carry signal output end OC to be electrically connected to the first low voltage end under the control of the potential at the first pull-down node PDo, and control the carry signal output end OC to be electrically connected to the first low voltage end under the control of the potential at the second pull-down node PDe. The first low voltage end is configured to input a first low voltage VSS1.

In FIG. 8, the third voltage end may be, but is not limited to, the first low voltage end.

According to the gate driving unit in FIG. 8, through the additional carry signal output circuit 17 and the carry signal resetting circuit 18, it is able to control the carry signal output end OC to output a carry signal and provide an input signal for a next-level gate driving unit. The output of the gate driving signal may be separated from the output of the carry signal, so it is able to increase an output driving capability of the gate driving unit.

To be specific, the carry signal output circuit may include a carry signal output transistor, and the carry signal resetting circuit may include a first carry signal resetting transistor and a second carry signal resetting transistor. A control electrode of the carry signal output transistor may be connected to the pull-up node, a first electrode of the carry signal output transistor may be connected to the clock signal end, and a second electrode of the carry signal output transistor may be connected to the carry signal output end. A control electrode of the first carry signal resetting transistor may be connected to the first pull-down node, a first electrode of the first carry signal resetting transistor may be connected to the carry signal output end, and a second electrode of the first carry signal resetting transistor may be connected to the third voltage end. A control electrode of the second carry signal resetting transistor may be connected to the second pull-down node, a first electrode of the second carry signal resetting transistor may be connected to the carry signal output end, and a second electrode of the second carry signal resetting transistor may be connected to the third voltage end.

Within the output cutoff maintenance time period, when the carry signal output transistor is an n-type transistor, the potential at the pull-up node may be reset by the pull-up node resetting circuit to be the low level Vgl which may be smaller than a second level inputted by CLK, so a gate-to-source voltage of the carry signal output transistor may be smaller than 0, and a stress may be applied in a reverse direction to the carry signal output transistor. In this way, it is able to prevent a threshold voltage of the carry signal output transistor from being drifted.

Within the output cutoff maintenance time period, when the carry signal output transistor is a p-type transistor, the potential at the pull-up node may be reset by the pull-up node resetting circuit to be the high level Vgh which may be smaller than the second level inputted by CLK, so the gate-to-source voltage of the carry signal output transistor may be greater than 0, and a stress may be applied in a reverse direction to the carry signal output transistor. In this way, it is able to prevent the threshold voltage of the carry signal output transistor from being drifted.

When the first carry signal resetting transistor and the second carry signal resetting transistor are each an n-type transistor, within the output cutoff maintenance time period of the first voltage output stage, the potential at the first pull-down node may be the active voltage, and the potential at the second pull-down node may be the low level Vgl which may be smaller than a third voltage inputted by the third voltage end, so a gate-to-source voltage of the second carry signal resetting transistor may be smaller than 0, and a stress may be applied in a reverse direction to the second carry signal resetting transistor. In this way, it is able to prevent a threshold of the second carry signal resetting transistor from being drifted.

When the first carry signal resetting transistor and the second carry signal resetting transistor are each an n-type transistor, within the output cutoff maintenance time period of the second voltage output stage, the potential at the second pull-down node may be the active voltage, and the potential at the first pull-down node may be the low level Vgl which may be smaller than the third voltage inputted by the third voltage end, so a gate-to-source voltage of the first carry signal resetting transistor may be smaller than 0, and a stress may be applied in a reverse direction to the first carry signal resetting transistor. In this way, it is able to prevent a threshold of the first carry signal resetting transistor from being drifted.

When the first carry signal resetting transistor and the second carry signal resetting transistor are each a p-type transistor, within the output cutoff maintenance time period of the first voltage output stage, the potential at the first pull-down node may be the active voltage, and the potential at the second pull-down node may be the high level Vgh which may be greater than the third voltage inputted by the third voltage end, so the gate-to-source voltage of the second carry signal resetting transistor may be greater than 0, and a stress may be applied in a reverse direction to the second carry signal resetting transistor. In this way, it is able to prevent the threshold of the second carry signal resetting transistor from being drifted.

When the first carry signal resetting transistor and the second carry signal resetting transistor are each a p-type transistor, within the output cutoff maintenance time period of the second voltage output stage, the potential at the second pull-down node may be the active voltage, and the potential at the first pull-down node may be the high level Vgh which may be greater than the third voltage inputted by the third voltage end, so the gate-to-source voltage of the first carry signal resetting transistor may be greater than 0, and a stress may be applied in a reverse direction to the first carry signal resetting transistor. In this way, it is able to prevent the threshold of the first carry signal resetting transistor from being drifted.

During the implementation, the gate driving unit may further include a pull-up node control circuit connected to the pull-up node, an input end, a resetting end, a frame start control end and a fourth voltage end, and configured to control the pull-up node to be electrically connected to the input end under the control of an input signal from the input end, control the pull-up node to be electrically connected to the fourth voltage end under the control of a resetting signal from the resetting end, control the pull-up node to be electrically connected to the fourth voltage end under the control of a frame start control signal from the frame start control end, and maintain the potential at the pull-up node.

Figure 9:
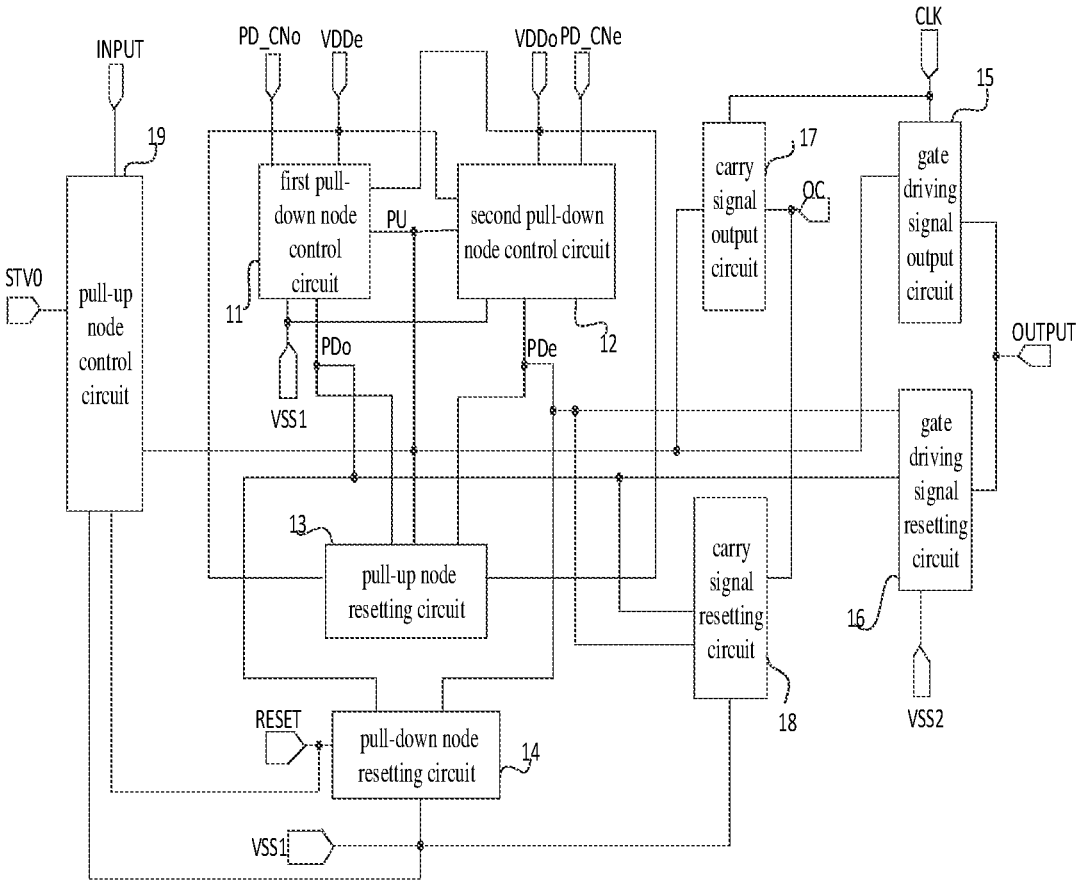
FIG. 9 is still yet another schematic view showing the gate driving unit according to one embodiment of the present disclosure.

As shown in FIG. 9, on the basis of the gate driving unit in FIG. 8, the gate driving unit may further include a pull-up node control circuit 19 connected to the pull-up node PU, an input end INPUT, the resetting end RESET, a frame start control end STV0 and a first low voltage end, and configured to control the pull-up node PU to be electrically connected to the input end INPUT under the control of an input signal from the input end INPUT, control the pull-up node PU to be electrically connected to the first low voltage end under the control of a resetting signal from the resetting end RESET, control the pull-up node PU to be electrically connected to the first low voltage end under the control of a frame start control signal from the frame start control end STV0, and maintain the potential at the pull-up node PU. The first low voltage end is configured to input the first low voltage VSS1.

In FIG. 9, the fourth voltage end may be, but is not limited to, the first low voltage end.

During the operation of the gate driving unit in FIG. 9, before the start of a display period for one frame of image, STV0 may input the active voltage, so as to reset the potential at PU. In addition, INPUT may be connected to a gate driving signal output end or a carry signal output end of a previous-level gate driving unit, and RESET may be connected to a gate driving signal output end or a carry signal output end of a next-level gate driving unit. The pull-up node control circuit 19 is configured to control the potential at PU.

During the implementation, the pull-up node control circuit may include an input transistor, a resetting transistor, a frame start control transistor and a storage capacitor. A control electrode and a first electrode of the input transistor may be connected to the input end, and a second electrode of the input transistor may be connected to the pull-up node. A control electrode of the resetting transistor may be connected to the resetting end, a first electrode of the resetting transistor may be connected to the pull-up node, and a second electrode of the resetting transistor may be connected to the fourth voltage end. A control electrode of the frame start control transistor may be connected to the frame start control end, a first electrode of the frame start control transistor may be connected to the pull-up node, and a second electrode of the frame start control transistor may be connected to the fourth voltage end. A first end of the storage capacitor may be connected to the pull-up node, and a second end of the storage capacitor may be connected to the gate driving signal output end.

The gate driving unit will be described hereinafter in more details in conjunction with a specific embodiment.

Figure 10:
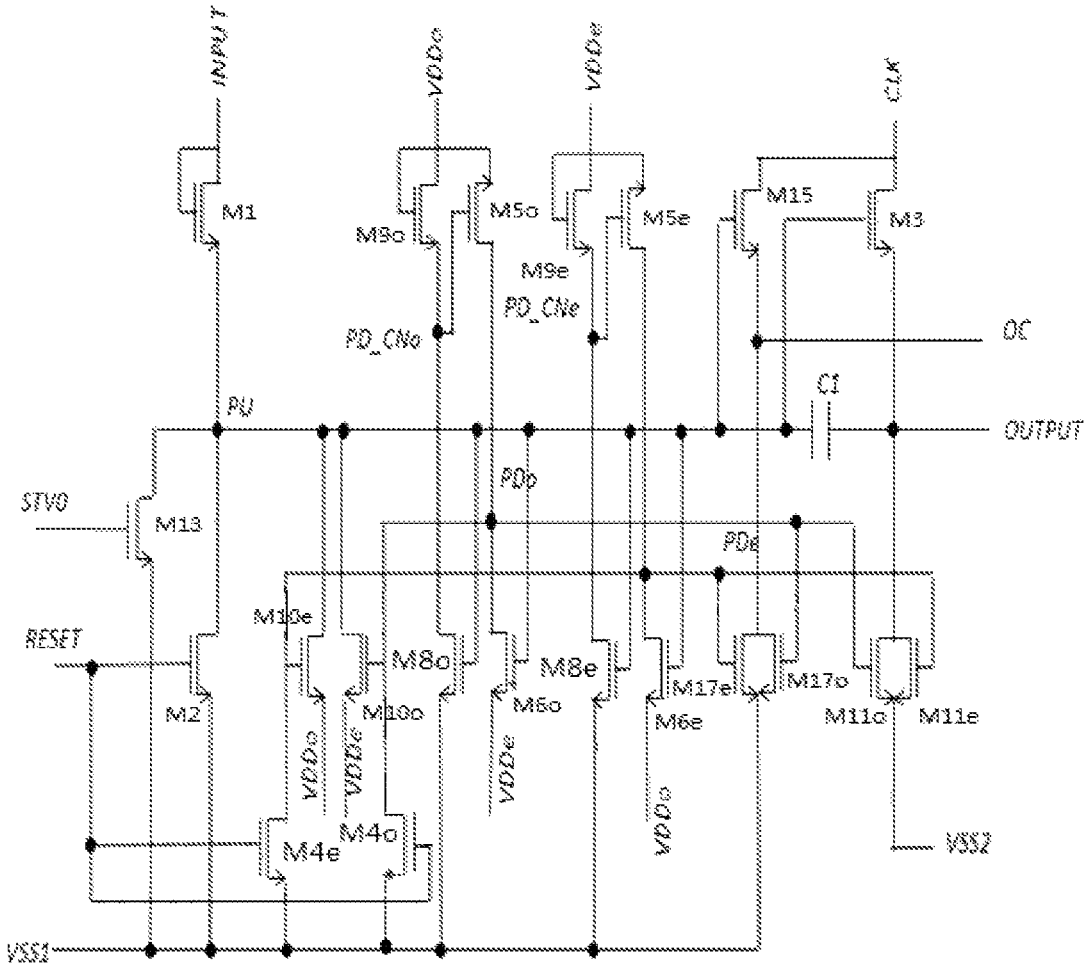
FIG. 10 is a circuit diagram of the gate driving unit according to one embodiment of the present disclosure.

As shown in FIG. 10, the gate driving unit may include a first pull-down node control circuit, a second pull-down node control circuit, a pull-up node resetting circuit, a gate driving signal output end OUTPUT, a gate driving signal output circuit, a gate driving signal resetting circuit, a carry signal output end OC, a carry signal output circuit, a carry signal resetting circuit and a pull-up node control circuit.

The first pull-down node control circuit may include a first pull-down node control transistor M6*o*, a first control transistor M9*o*, a second control transistor M8*o*, and a third control transistor M5*o*. A gate electrode of the first pull-down node control transistor M6*o* may be connected to the pull-up node PU, a drain electrode of the first pull-down node control transistor M6*o* may be connected to the first pull-down node PDo, and a source electrode of the first pull-down node control transistor M6*o* may be connected to the second control voltage VDDe. A gate electrode and a drain electrode of the first control transistor M90 may be connected to the first control voltage end VDDo, and a source electrode of the first control transistor M90 may be connected to the first pull-down control node PD_CNo. A gate electrode of the second control transistor M8*o* may be connected to the pull-up node PU, a drain electrode of the second control transistor M8*o* may be connected to the first pull-down control node PD_CNo, and a source electrode of the second control transistor M8*o* may be connected to the first low voltage end. A gate electrode of the third control transistor M5*o* may be connected to the first pull-down control node PD_CNo, a drain electrode of the third control transistor M5*o* may be connected to the first control voltage end VDDo, and a source electrode of the third control transistor M5*o* may be connected to the first pull-down node PDo.

The second pull-down node control circuit may include a second pull-down node control transistor M6*e*, a fourth control transistor M9*e*, a fifth control transistor M8*e* and a sixth control transistor M5*e*. A gate electrode of the second pull-down node control transistor M6*e* may be connected to the pull-up node PU, a drain electrode of the second pull-down node control transistor M6*e* may be connected to the second pull-down node PUe, and a source electrode of the second pull-down node control transistor M6*e* may be connected to the first control voltage end VDDo. A gate electrode and a drain electrode of the fourth control transistor M9*e* may be connected to the second control voltage end VDDe, and a source electrode of the fourth control transistor M9*e* may be connected to the second pull-down control node PD_CNe. A gate electrode of the fifth control transistor M8*e* may be connected to the pull-up node PU, a drain electrode of the fifth control transistor M8*e* may be connected to the second pull-down control node PD_CNe, and a source electrode of the fifth control transistor M8*e* may be connected to the first low voltage end. A gate electrode of the sixth control transistor M5*e* may be connected to the second pull-down control node PD_CNe, a drain electrode of the sixth control transistor M5*e* may be connected to the second control voltage end VDDe, and a source electrode of the sixth control transistor M5*e* may be connected to the second pull-down node PDe.

The pull-up node resetting circuit may include a first pull-up node resetting transistor M10*o* and a second pull-up node resetting transistor M10*e*. A gate electrode of M10*o* may be connected to the first pull-down node PDo, a drain electrode of M10*o* may be connected to the pull-up node PU, and a source electrode of M10*o* may be connected to the second control voltage end VDDe. A gate electrode of M10*e* may be connected to the second pull-node node PDe, a drain electrode of M10*e* may be connected to the pull-up node PU, and a source electrode of M10*e* may be connected to the first control voltage end VDDo.

The pull-down node resetting circuit may include a first pull-down node resetting transistor M4*o* and a second pull-down node resetting transistor M4*e*. A gate electrode of the first pull-down node resetting transistor M4*o* may be connected to the resetting end RESET, a drain electrode of the first pull-down node resetting transistor M4*o* may be connected to the first pull-down node PDo, and a source electrode of the first pull-down node resetting transistor M4*o* may be connected to a first low voltage end. The first low voltage end is configured to input the first low voltage VSS1. A gate electrode of the second pull-down node resetting transistor M4*e* may be connected to the resetting end RESET, a drain electrode of the second pull-down node resetting transistor M4*e* may be connected to the second pull-down node PDe, and a source electrode of the second pull-down node resetting transistor M4*e* may be connected to the first low voltage end.

The gate driving signal output circuit may include a gate driving signal output transistor M3, and the gate driving signal resetting circuit may include a first gate driving signal resetting transistor M11*o* and a second gate driving signal resetting transistor M11*e*. A gate electrode of the gate driving signal output transistor M3 may be connected to the pull-up node PU, a drain electrode of the gate driving signal output transistor M3 may be connected to the clock signal end CLK, and a source electrode of the gate driving signal output transistor M3 may be connected to the gate driving signal output end OUTPUT. A gate electrode of the first gate driving signal resetting transistor M11*o* may be connected to the first pull-down node PDo, a drain electrode of the first gate driving signal resetting transistor M11*o* may be connected to the gate driving signal output end OUTPUT, and a source electrode of the first gate driving signal resetting transistor M11*o* may be connected to a second low voltage end. The second low voltage end is configured to input the second low voltage VSS2. A gate electrode of the second gate driving signal resetting transistor M11*e* may be connected to the second pull-down node PDe, a drain electrode of the second gate driving signal resetting transistor M11*e* may be connected to the gate driving signal output end OUTPUT, and a source electrode of the second gate driving signal resetting transistor M11*e* may be connected to the second low voltage end.

The carry signal output circuit may include a carry signal output transistor M15, and the carry signal resetting circuit may include a first carry signal resetting transistor M17*o* and a second carry signal resetting transistor M17*e*. A gate electrode of the carry signal output transistor M15 may be connected to the pull-up node PU, a drain electrode of the carry signal output transistor M15 may be connected to the clock signal end CLK, and a source electrode of the carry signal output transistor M15 may be connected to the carry signal output end OC. A gate electrode of the first carry signal resetting transistor M17*o* may be connected to the first pull-down node PDo, a drain electrode of the first carry signal resetting transistor M17*o* may be connected to the carry signal output end OC, and a source electrode of the first carry signal resetting transistor M17*o* may be connected to the first low voltage end. A gate electrode of the second carry signal resetting transistor M17*e* may be connected to the second pull-down node PDe, and a drain electrode of the second carry signal resetting transistor M17*e* may be connected to the carry signal output end OC, and a source electrode of the second carry signal resetting transistor M17*e* may be connected to the first low voltage end.

The pull-up node control circuit may include an input transistor M1, a resetting transistor M2, a frame start control transistor M13, and a storage capacitor C1. A gate electrode and a drain electrode of the input transistor M1 may be connected to the input end INPUT, and a source electrode of the input transistor INPUT may be connected to the pull-up node PU. A gate electrode of the resetting transistor M2 may be connected to the resetting end RESET, a drain electrode of the resetting transistor M2 may be connected to the pull-up node PU, and a source electrode of the resetting transistor M2 may be connected to the first low voltage end. A gate electrode of the frame start control transistor M13 may be connected to the frame start control end STV0, a drain electrode of the frame start control transistor M13 may be connected to the pull-up node PU, and a source electrode of the frame start control transistor M13 may be connected to the first low voltage end. A first end of the storage capacitor C1 may be connected to the pull-up node PU, and a second end of the storage capacitor C1 may be connected to the gate driving signal output end OUTPUT.

During the implementation, VSS1 may be, but is not limited to, equal to VSS2. In FIG. 10, all the transistors may be, but are not limited to, n-type transistors.

During the operation of the gate driving unit in FIG. 10, a driving time may include a plurality of voltage output periods, and each voltage output period may include a first voltage output stage and a second voltage output stage. A duration of each of the first voltage output stage and the second voltage output stage may be, but are not limited to, 2*s*.

At the first voltage output stage, the second control voltage end VDDe may input a high voltage, and the first control voltage end VDDo may input a low voltage. At the second voltage output stage, the first control voltage end VDDo may input a low voltage, and the second control voltage end VDDe may input the inactive voltage.

Figure 11:
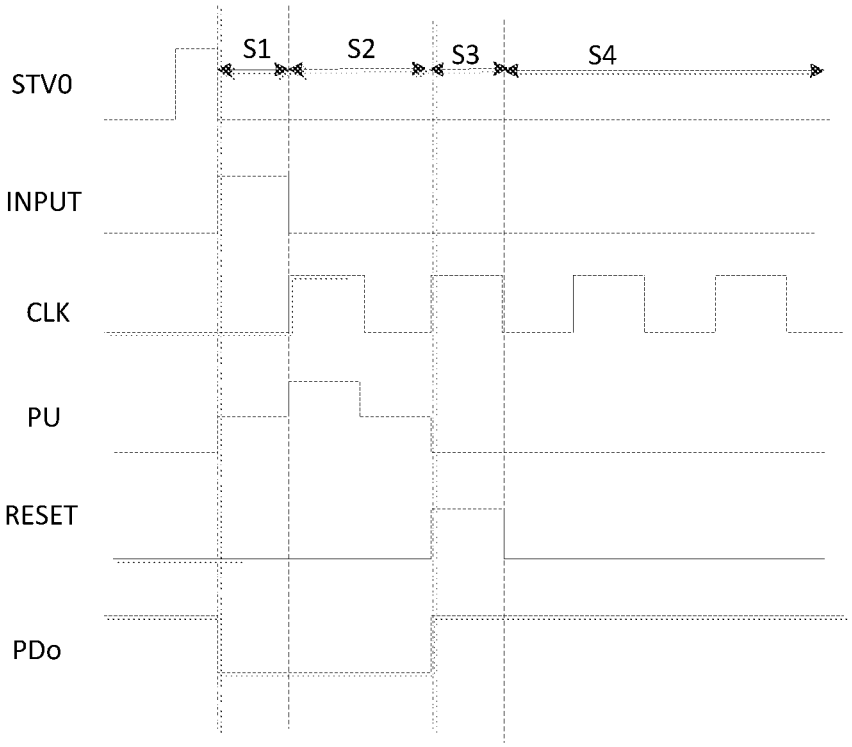
FIG. 11 is a time sequence diagram of the gate driving unit according to one embodiment of the present disclosure.

During the operation of the gate diving unit in FIG. 10, the first voltage output stage may include at least one display period, and the second voltage output stage may include at least one display period. Each display period may include an input time period, an output time period, a resetting time period and an output cutoff maintenance time period arranged sequentially. FIG. 11 shows a time sequence diagram of the gate driving unit in FIG. 10 at the first voltage output stage. At the first voltage output stage, VDDe may input a low voltage, so the potential at PDe may be the low voltage all the time.

In FIG. 11, S1 represents the input time period, S2 represents the output time period, S3 represents the resetting time period, and S4 represents the output cutoff maintenance time period. Within the input time period S1, INPUT may output a high voltage. Within the resetting time period S3, RESET may output a high voltage. Within the input time period S1 and the output time period S2, the potential at PU may be a high voltage. Within the input time period S1 and the output time period S2, the potential at PDo may be a low voltage. Within the resetting time period S3 and the output cutoff maintenance time period S4, the potential at PDo may be a high voltage.

Because VDDo and VDDe operate alternately (i.e., VDDo and VDDe input the active voltage alternately), the source electrode of M10*e* and the source electrode of M6*e* may be connected to VDDo, and the source electrode of M10*o* and the source electrode of M6*o* may be connected to VDDe. When VDDo inputs a low voltage, VDDe inputs a high voltage, and the potential at PU is a high potential, the potential at PDo may be a low voltage, so a stress may be applied in a reverse direction to M10*o*. When VDDo inputs a high voltage, VDDe inputs a low voltage, and the potential at PU is a high voltage, the potential at PDe may be a low voltage, so a stress may be applied in a reverse direction to M10*e*. When VDDo inputs a low voltage, VDDe inputs a high voltage, and the potential at PU is a low potential, a stress may be applied in a reverse direction to each of M10*o* and M6*o*, so as to enable the threshold voltage of each M10*o* and M6*o* to be drifted backward. When VDDe inputs a low voltage, VDDo inputs a high voltage, and the potential at PU is a low voltage, a stress may be applied in a reverse direction to each of M10*e* and M6*e*, so as to enable the threshold voltage of each M10*e* and M6*e* to be drifted backward.

In addition, for the gate driving unit in FIG. 10, the inactive voltage inputted by VDDo and the inactive voltage inputted by VDDe may each be the low level Vgl which may be smaller than VSS1 and smaller than VSS2. In this way, it is able to effectively recover characteristics of M8*o*, M8*e*, M11*o*, M11*e*, M17*o* and M17*e*.

In addition, during the operation of the gate driving unit in FIG. 10, CLK may input a high voltage and a low voltage alternately. When CLK inputs a high voltage and the potential at PU is a low voltage, a stress may be applied in a reverse direction to each of M3 and M15, so as to enable the threshold voltage of each of M3 and M15 to be drifted backward.

Figure 12A:
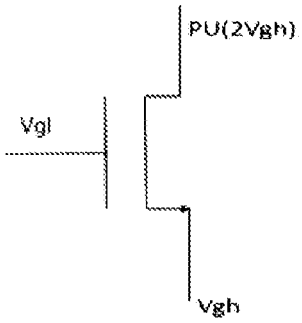
FIGS. 12A, 12B, 12C, 12D and 12E are schematic views showing voltages applied to transistors of the gate driving unit according to one embodiment of the present disclosure.

As shown in FIG. 12A, within the output time period S2 of the first voltage output stage, VDDo may input the high level Vgh, VDDe may input the low level Vgl, the potential at PDe may be Vgl, an the potential at PU may be bootstrapped to 2Vgh, so a potential at the gate electrode of M10*e* may be Vgl, a potential at the drain electrode of M10*e* may be 2Vgh, and a potential at the source electrode of M10*e* may be Vgh. The potential at the gate electrode of M10*e* may be the smallest, and the potential at each of the drain electrode and the source electrode of M10*e* may be greater than the potential at the gate electrode of M10*e*, so M10*e* may not be turned on, and the characteristic of M10*e* may be drifted leftward.

Figure 12B:
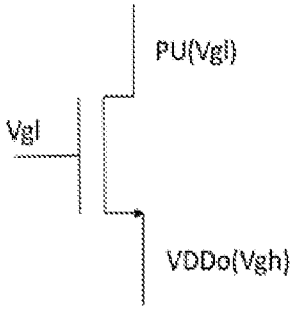

As shown in FIG. 12B, within the resetting time period S3 and the output cutoff maintenance time period S4 of the first voltage output stage, VDDo may input the high level Vgh, VDDe may input the low level Vgl, the potential at PDe may be the low level Vgl, and the potential at PU may be the low level Vgl, so the potential at the gate electrode of M10*e* may be Vgl, the potential at the drain electrode of M10*e* may be Vgl, the potential at the source electrode of M10*e* may be Vgh, a potential at the gate electrode of M6*e* may be Vgl, a potential at the drain electrode of M6*e* may be Vgl, and a potential at the source electrode of M6*e* may be Vgh. At this time, a stress may be applied in a reverse direction to each of M10*e* and M6*e*.

Figure 12C:
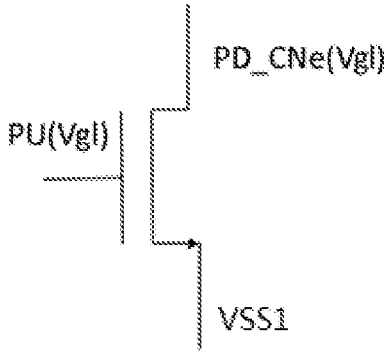

As shown in FIG. 12C, within the resetting time period S3 and the output cutoff maintenance time period S4 of the first voltage output stage, VDDo may input the high level Vgh, VDDe may input the low level Vgl, the potential at PDe may be the low level Vgl, and the potential at PU may be the low level Vgl, so a potential at the gate electrode of M8*e* may be Vgl, a potential at the drain electrode of M8*e* may be the potential at PD_CNe, i.e., Vgl, and a potential at the source electrode of M8*e* may be VSS1. Vgl may be set to be smaller than VSS1, so as to apply a stress in a reverse direction to M8*e*.

Figure 12D:
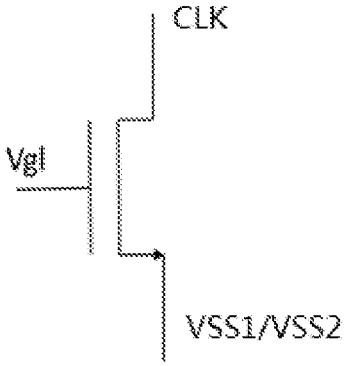

As shown in FIG. 12D, within the resetting time period S3 and the output cutoff maintenance time period S4 of the first voltage output stage, VDDo may input the high level Vgh, VDDe may input the low level Vgl, and the potential at PU may be the low level Vgl, so a potential at the gate electrode of M3 may be Vgl, the drain electrode of M3 may be connected to CLK, and a potential at the source electrode of M3 may be VSS2. When CLK inputs a high level, a stress may be applied in a reverse direction to M3. A potential at the gate electrode of M3 may be Vgl. The drain electrode of M15 may be connected to CLK, and a potential at the source electrode of M15 may be VSS1. When CLK inputs a high level, a stress may be applied in a reverse direction to M15.

Figure 12E:
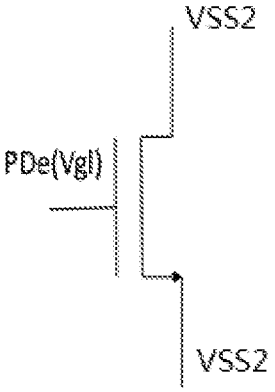

As shown in FIG. 12E, within the resetting time period S3 and the output cutoff maintenance time period S4 of the first voltage output stage, VDDo may input the high level Vgh, VDDe may input the low level Vgl, and the potential at PDe may be the low level Vgl, so a potential at the gate electrode of M11*e* may be Vgl, a potential at the drain electrode of M11*e* may be VSS2, and a potential at the source electrode of M11*e* may also be VSS2. At this time, a stress may be applied in a reverse direction to M11*e*. A potential at the gate electrode of M17*e* may be Vgl, a potential at the drain electrode of M17*e* may be VSS2, and a potential at the source electrode of M17*e* may also be VSS2. At this time, a stress may be applied in a reverse direction to M17*e*.

The present disclosure further provides in some embodiments a gate driving method for the above-mentioned gate driving unit. A driving time may include a plurality of voltage output periods, and each voltage output period may include a first voltage output stage and a second voltage output stage arranged sequentially. The first voltage output stage may include at least one display period, and the second voltage output stage may include at least one display period. Each display period may include an input time period, an output time period, a resetting time period and an output cutoff maintenance time period arranged sequentially. The gate driving method may include: at the first voltage output stage, enabling the first control voltage end to input an active voltage, and enabling the second control voltage end to input an inactive voltage; at the second voltage output stage, enabling the first control voltage end to input an inactive voltage and enabling the second control voltage end to input an active voltage; within the input time period and the output time period of the first voltage output stage, enabling a potential at the pull-up node to be the active voltage, controlling, by the first pull-down node control circuit, a potential at the first pull-down node to be the inactive voltage, and controlling, by the second pull-down node control circuit, a potential at the second pull-down node to be the inactive voltage; within the output cutoff maintenance time period and the resetting time period of the first voltage output stage and the resetting time period and the output cutoff maintenance time period of the second voltage output stage, enabling the potential at the pull-up node to be the inactive voltage, controlling, by the first pull-down node control circuit, the first pull-down node to be electrically disconnected from the second control voltage end, and controlling, by the second pull-down node control circuit, the second pull-down node to be electrically disconnected from the first control voltage end; within the output cutoff maintenance time period of the first voltage output stage, controlling, by the first pull-down node control circuit, the potential at the first pull-down node to be the active voltage, controlling, by the second pull-down node control circuit, the potential at the second pull-down node to be the inactive voltage, controlling, by the pull-up node resetting circuit, the pull-up node to be electrically connected to the second control voltage end under the control of the potential at the first pull-down node, and controlling, by the pull-up node resetting circuit, the pull-up node to be electrically disconnected from the first control voltage end under the control of the potential at the second pull-down node; and within the output cutoff maintenance time period of the second voltage output stage, controlling, by the first pull-down node control circuit, the potential at the first pull-down node to be the inactive voltage, controlling, by the second pull-down node control circuit, the potential at the second pull-down node to be the active voltage, controlling, by the pull-up node resetting circuit, the pull-up node to be electrically connected to the first control voltage end under the control of the potential at the second pull-down node, and controlling, by the pull-up node resetting circuit, the pull-up node to be electrically disconnected from the second control voltage end under the control of the potential at the first pull-down node.

To be specific, the gate driving unit may further include a pull-down node resetting circuit. The gate driving method may further include, within the resetting time period of the first voltage output stage and the resetting time period of the second voltage output stage, controlling, by the pull-down node resetting circuit, the first pull-down node and the second pull-down node to be electrically connected to the first level end under the control of a resetting signal from the resetting end, so as to enable the potential at the first pull-down node and the potential at the second pull-down node to be each the inactive voltage.

In a possible embodiment of the present disclosure, the gate driving unit may further include a gate driving signal output circuit, a gate driving signal resetting circuit, a carry signal output circuit and a carry signal resetting circuit. The first pull-down node control circuit and the second pull-down node control circuit may be connected to the first voltage end, the gate driving signal output circuit and the carry signal output circuit may be connected to the clock signal end, the gate driving signal resetting circuit may be connected to the second voltage end, and the carry signal resetting circuit may be connected to the third voltage end. A transistor included in the first pull-down node control circuit, a transistor included in the second pull-down node control circuit, a transistor included in the gate driving signal output circuit, a transistor included in the gate driving signal resetting circuit, a transistor included in the carry signal output circuit and a transistor included in the carry signal resetting circuit may be all n-type transistors. The inactive voltage inputted by the first control voltage end the inactive voltage inputted by the second control voltage end may be each a low level Vgl which is smaller than a first voltage from the first voltage end, smaller than a second voltage inputted by the second voltage end and smaller than a third voltage inputted by the third voltage end.

In another possible embodiment of the present disclosure, the gate driving unit may further include a gate driving signal output circuit, a gate driving signal resetting circuit, a carry signal output circuit and a carry signal resetting circuit. The first pull-down node control circuit and the second pull-down node control circuit may be connected to the first voltage end, the gate driving signal output circuit and the carry signal output circuit may be connected to the clock signal end, the gate driving signal resetting circuit may be connected to the second voltage end, and the carry signal resetting circuit may be connected to the third voltage end. A transistor included in the first pull-down node control circuit, a transistor included in the second pull-down node control circuit, a transistor included in the gate driving signal output circuit, a transistor included in the gate driving signal resetting circuit, a transistor included in the carry signal output circuit and a transistor included in the carry signal resetting circuit may be all p-type transistors. The inactive voltage inputted by the first control voltage end and the inactive voltage inputted by the second control voltage end may be each a high level Vgh which is larger than than a first voltage from the first voltage end, larger than a second voltage inputted by the second voltage end and larger than a third voltage inputted by the third voltage end.

The present disclosure further provides in some embodiments a gate driving circuit including a plurality of levels of the above-mentioned gate driving units.

The present disclosure further provides in some embodiments a display device including the above-mentioned gate driving circuit. The display device may be any product or member having a display function, e.g., mobile phone, flat-panel computer, television, display, laptop computer, digital photo frame, or navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A gate driving unit, comprising a first pull-down node control circuit, a second pull-down node control circuit and a pull-up node resetting circuit, wherein:

the first pull-down node control circuit is connected to a pull-up node, a first pull-down node and a second control voltage end, and configured to control the first pull-down node to be electrically connected to, or electrically disconnected from, the second control voltage end under the control of a potential at the pull-up node;

the second pull-down node control circuit is connected to the pull-up node, a second pull-down node and a first control voltage end, and configured to control the second pull-down node to be electrically connected to, or electrically disconnected from, the first control voltage end under the control of the potential at the pull-up node; and the pull-up node resetting circuit is connected to the first pull-down node, the second pull-down node, the pull-up node, the first control voltage end and the second control voltage end, and configured to control the pull-up node to be electrically connected to the second control voltage end under the control of a potential at the first pull-down node, and control the pull-up node to be electrically connected to the first control voltage end under the control of a potential at the second pull-down node;

wherein a driving time comprises a plurality of voltage output periods, and each voltage output period comprises a first voltage output stage and a second voltage output stage arranged sequentially, and wherein:

the first voltage output stage comprises at least one display period, and the second voltage output stage comprises at least one display period, and each display period comprises an input time period, an output time period, a resetting time period and an output cutoff maintenance time period arranged sequentially;

wherein the gate driving method comprises:

at the first voltage output stage, enabling the first control voltage end to input an active voltage, and enabling the second control voltage end to input an inactive voltage;

at the second voltage output stage, enabling the first control voltage to input an inactive voltage and enabling the second control voltage end to input an active voltage;

within the input time period and the output time period of the first voltage output stage, enabling a potential at the pull-up node to be the active voltage, controlling, by the first pull-down node control circuit, a potential at the first pull-down node to be the inactive voltage, and controlling, by the second pull-down node control circuit, a potential at the second pull-down node to be the inactive voltage;

within the output cutoff maintenance time period and the resetting time period of the first voltage output stage and the resetting time period and the output cutoff maintenance time period of the second voltage output stage, enabling the potential at the pull-up node to be the inactive voltage, controlling, by the first pull-down node control circuit, the first pull-down node to be electrically disconnected from the second control voltage end, and controlling, by the second pull-down node control circuit, the second pull-down node to be electrically disconnected from the first control voltage end;

within the output cutoff maintenance time period of the first voltage output stage, controlling, by the first pull-down node control circuit, the potential at the first pull-down node to be the active voltage, controlling, by the second pull-down node control circuit, the potential at the second pull-down node to be the inactive voltage, controlling, by the pull-up node resetting circuit, the pull-up node to be electrically connected to the second control voltage end under the control of the potential at the first pull-down node, and controlling, by the pull-up node resetting circuit, the pull-up node to be electrically disconnected from the first control voltage end under the control of the potential at the second pull-down node; and within the output cutoff maintenance time period of the second voltage output stage, controlling, by the first pull-down node control circuit, the potential at the first pull-down node to be the inactive voltage, controlling, by the second pull-down node control circuit, the potential at the second pull-down node to be the active voltage, controlling, by the pull-up node resetting circuit, the pull-up node to be electrically connected to the first control voltage end under the control of the potential at the second pull-down node, and controlling, by the pull-up node resetting circuit, the pull-up node to be electrically disconnected from the second control voltage end under the control of the potential at the first pull-down node.

2. The gate driving unit according to claim 1, further comprising a pull-down node resetting circuit connected to a resetting end, the first pull-down node, the second pull-down node and a first level end, and configured to, under the control of a resetting signal from the resetting end, control the first pull-down node to be electrically connected to the first level end, and control the second pull-down node to be electrically connected to the first level end.

3. The gate driving unit according to claim 2, wherein the pull-down node resetting circuit comprises a first pull-down node resetting transistor and a second pull-down node resetting transistor, and wherein:

a control electrode of the first pull-down node resetting transistor is connected to the resetting end, a first electrode of the first pull-down node resetting transistor is connected to the first pull-down node, and a second electrode of the first pull-down node resetting transistor is connected to the first level end; and a control electrode of the second pull-down node resetting transistor is connected to the resetting end, a first electrode of the second pull-down node resetting transistor is connected to the second pull-down node, and a second electrode of the second pull-down node resetting transistor is connected to the first level end.

4. The gate driving unit according to claim 1, wherein:

the first pull-down node control circuit comprises a first pull-down node control transistor, a control electrode of which is connected to the pull-up node, a first electrode of which is connected to the first pull-down node, and a second electrode of which is connected to the second control voltage end; and the second pull-down node control circuit comprises a second pull-down node control transistor, a control electrode of which is connected to the pull-up node, a first electrode of which is connected to the second pull-down node, and a second electrode of which is connected to the first control voltage end.

5. The gate driving unit according to claim 1, wherein the pull-up node resetting circuit comprises a first pull-up node resetting transistor and a second pull-up node resetting transistor, and wherein:

a control electrode of the first pull-up node resetting transistor is connected to the first pull-down node, a first electrode of the first pull-up node resetting transistor is connected to the pull-up node, and a second electrode of the first pull-up node resetting transistor is connected to the second control voltage end; and a control electrode of the second pull-up node resetting transistor is connected to the second pull-down node, a first electrode of the second pull-up node resetting transistor is connected to the pull-up node, and a second electrode of the second pull-up node resetting transistor is connected to the first control voltage end.

6. The gate driving unit according to claim 1, wherein:

the first pull-down node control circuit is further connected to a first pull-down control node, the first control voltage end and a first voltage end, and configured to control a potential at the first pull-down control node under the control of a first control voltage signal from the first control voltage end and the potential at the pull-up node, and control the first control voltage end to be electrically connected to the first pull-down node under the control of a potential at the first pull-down control node; and the second pull-down node control circuit is further connected to a second pull-down control node, the second control voltage end and the first voltage end, and configured to control a potential at the second pull-down control node under the control of a second control voltage signal from the second control voltage end and the potential at the pull-up node, and control the second control voltage end to be electrically connected to the second pull-down node under the control of a potential at the second pull-down control node.

7. The gate driving unit according to claim 6, wherein the first pull-down node control circuit further comprises a first control transistor, a second control transistor and a third control transistor, and wherein:

a control electrode and a first electrode of the first control transistor are connected to the first control voltage end, and a second electrode of the first control transistor is connected to the first pull-down control node;

a control electrode of the second control transistor is connected to the pull-up node, a first electrode of the second control transistor is connected to the first pull-down control node, and a second electrode of the second control transistor is connected to the first voltage end; and a control electrode of the third control transistor is connected to the first pull-down control node, a first electrode of the third control transistor is connected to the first control voltage end, and a second electrode of the third control transistor is connected to the first pull-down node.

8. The gate driving unit according to claim 6, wherein the second pull-down node control circuit further comprises a fourth control transistor, a fifth control transistor and a sixth control transistor, and wherein:

a control electrode and a first electrode of the fourth control transistor are connected to the second control voltage end, and a second electrode of the fourth control transistor is connected to the second pull-down control node;

a control electrode of the fifth control transistor is connected to the pull-up node, a first electrode of the fifth control transistor is connected to the second pull-down control node, and a second electrode of the fifth control transistor is connected to the first voltage end; and a control electrode of the sixth control transistor is connected to the second pull-down control node, a first electrode of the sixth control transistor is connected to the second control voltage end, and a second electrode of the sixth control transistor is connected to the second pull-down node.

9. The gate driving unit according to claim 1, further comprising a gate driving signal output end, a gate driving signal output circuit and a gate driving signal resetting circuit, wherein:

the gate driving signal output circuit is connected to the pull-up node, a clock signal end and the gate driving signal output end, and configured to control the gate driving signal output end to be electrically connected to the clock signal end under the control of the potential at the pull-up node; and the gate driving signal resetting circuit is connected to the first pull-down node, the second pull-down node, the gate driving signal output end and a second voltage end, and configured to control the gate driving signal output end to be electrically connected to the second voltage end under the control of the potential at the first pull-down node, and control the gate driving signal output end to be electrically connected to the second voltage end under the control of the potential at the second pull-down node.

10. The gate driving unit according to claim 9, wherein the gate driving signal output circuit comprises a gate driving signal output transistor, and the gate driving signal resetting circuit comprises a first gate driving signal resetting transistor and a second gate driving signal resetting transistor, and wherein:

a control electrode of the gate driving signal output transistor is connected to the pull-up node, a first electrode of the gate driving signal output transistor is connected to the clock signal end, and a second electrode of the gate driving signal output transistor is connected to the gate driving signal output end;

a control electrode of the first gate driving signal resetting transistor is connected to the first pull-down node, a first electrode of the first gate driving signal resetting transistor is connected to the gate driving signal output end, and a second electrode of the first gate driving signal resetting transistor is connected to the second voltage end; and a control electrode of the second gate driving signal resetting transistor is connected to the second pull-down node, a first electrode of the second gate driving signal resetting transistor is connected to the gate driving signal output end, and a second electrode of the second gate driving signal resetting transistor is connected to the second voltage end.

11. The gate driving unit according to claim 9, further comprising a carry signal output end, a carry signal output circuit and a carry signal resetting circuit, wherein:

the carry signal output circuit is connected to the pull-up node, the clock signal end and the carry signal output end, and configured to control the carry signal output end to be electrically connected to the clock signal end under the control of the potential at the pull-up node; and the carry signal resetting circuit is connected to the first pull-down node, the second pull-down node, the carry signal output end and a third voltage end, and configured to control the carry signal output end to be electrically connected to the third voltage end under the control of the potential at the first pull-down node, and control the carry signal output end to be electrically connected to the third voltage end under the control of the potential at the second pull-down node.

12. The gate driving unit according to claim 11, wherein the carry signal output circuit comprises a carry signal output transistor, and the carry signal resetting circuit comprises a first carry signal resetting transistor and a second carry signal resetting transistor, and wherein:

a control electrode of the carry signal output transistor is connected to the pull-up node, a first electrode of the carry signal output transistor is connected to the clock signal end, and a second electrode of the carry signal output transistor is connected to the carry signal output end;

a control electrode of the first carry signal resetting transistor is connected to the first pull-down node, a first electrode of the first carry signal resetting transistor is connected to the carry signal output end, and a second electrode of the first carry signal resetting transistor is connected to the third voltage end; and a control electrode of the second carry signal resetting transistor is connected to the second pull-down node, a first electrode of the second carry signal resetting transistor is connected to the carry signal output end, and a second electrode of the second carry signal resetting transistor is connected to the third voltage end.

13. The gate driving unit according to claim 1, further comprising a pull-up node control circuit connected to the pull-up node, an input end, a resetting end, a frame start control end and a fourth voltage end, and configured to control the pull-up node to be electrically connected to the input end under the control of an input signal from the input end, control the pull-up node to be electrically connected to the fourth voltage end under the control of a resetting signal from the resetting end, control the pull-up node to be electrically connected to the fourth voltage end under the control of a frame start control signal from the frame start control end, and maintain the potential at the pull-up node.

14. The gate driving method according to claim 1, wherein the gate driving unit further comprises a pull-down node resetting circuit, and the gate driving method further comprises:

within the resetting time period of the first voltage output stage and the resetting time period of the second voltage output stage, controlling, by the pull-down node resetting circuit, the first pull-down node and the second pull-down node to be electrically connected to the first level end under the control of a resetting signal from the resetting end, to enable the potential at the first pull-down node and the potential at the second pull-down node to be each the inactive voltage.

15. The gate driving method according to claim 14, wherein the gate driving unit further comprises a gate driving signal output circuit, a gate driving signal resetting circuit, a carry signal output circuit and a carry signal resetting circuit, and wherein:

the first pull-down node control circuit and the second pull-down node control circuit are connected to the first voltage end, the gate driving signal output circuit and the carry signal output circuit are connected to the clock signal end, the gate driving signal resetting circuit is connected to the second voltage end, and the carry signal resetting circuit is connected to the third voltage end;

a transistor comprised in the first pull-down node control circuit, a transistor comprised in the second pull-down node control circuit, a transistor comprised in the gate driving signal output circuit, a transistor comprised in the gate driving signal resetting circuit, a transistor comprised in the carry signal output circuit and a transistor comprised in the carry signal resetting circuit are all n-type transistors; and the inactive voltage inputted by the first control voltage end and the inactive voltage inputted by the second control voltage end are each a low level Vgl which is smaller than a first voltage from the first voltage end, smaller than a second voltage inputted by the second voltage end and smaller than a third voltage inputted by the third voltage end.

16. The gate driving method according to claim 14, wherein the gate driving unit further comprises a gate driving signal output circuit, a gate driving signal resetting circuit, a carry signal output circuit and a carry signal resetting circuit, and wherein:

the first pull-down node control circuit and the second pull-down node control circuit are connected to the first voltage end, the gate driving signal output circuit and the carry signal output circuit are connected to the clock signal end, the gate driving signal resetting circuit is connected to the second voltage end, and the carry signal resetting circuit is connected to the third voltage end;

a transistor comprised in the first pull-down node control circuit, a transistor comprised in the second pull-down node control circuit, a transistor comprised in the gate driving signal output circuit, a transistor comprised in the gate driving signal resetting circuit, a transistor comprised in the carry signal output circuit and a transistor comprised in the carry signal resetting circuit are all p-type transistors; and the inactive voltage inputted by the first control voltage end and the inactive voltage inputted by the second control voltage end are each a high level Vgh which is larger than a first voltage from the first voltage end, larger than a second voltage inputted by the second voltage end and larger than a third voltage inputted by the third voltage end.

17. A gate driving circuit comprising a plurality of levels of the gate driving units according to claim 1.

18. A display device, comprising the gate driving circuit according to claim 17.

* * * * *